US006901711B2

(12) United States Patent
Fay et al.

(10) Patent No.: US 6,901,711 B2
(45) Date of Patent: Jun. 7, 2005

(54) FACING AND FACED BUILDING INSULATION

(75) Inventors: Ralph Michael Fay, Lakewood, CO (US); John Brooks Smith, Littleton, CO (US); William David Blalock, Highlands Ranch, CO (US); Blake Boyd Bogrett, Littleton, CO (US); Timothy G. Swales, Englewood, CO (US)

(73) Assignee: Johns Manville International, Inc., Denver, CO (US)

( * ) Notice: Subject to any disclaimer, the term of this patent is extended or adjusted under 35 U.S.C. 154(b) by 30 days.

(21) Appl. No.: 10/291,333

(22) Filed: Nov. 8, 2002

(65) Prior Publication Data

US 2004/0088939 A1 May 13, 2004

(51) Int. Cl.[7] ..... E04B 1/74

(52) U.S. Cl. ..... 52/407.3; 52/407.1; 52/407.4; 52/98; 428/43; 428/126; 156/71

(58) Field of Search ..... 52/407.1, 407.3, 52/407.4, 404.1, 420, 98; 428/43, 55, 56, 57, 74, 126; 156/257, 71

(56) References Cited

U.S. PATENT DOCUMENTS 2,913,104 A * 11/1959 Konrad ..... 206/321
3,307,306 A * 3/1967 Oliver ..... 52/409
3,729,879 A * 5/1973 Franklin ..... 52/406.2
3,835,604 A * 9/1974 Hoffman, Jr. ..... 52/105
4,709,523 A * 12/1987 Broderick et al. ..... 52/506.05
4,952,441 A * 8/1990 Bose et al. ..... 428/121
5,001,879 A * 3/1991 Paliwoda ..... 52/309.8
5,331,787 A * 7/1994 Paulitschke et al. ..... 52/746.1
5,848,509 A * 12/1998 Knapp et al. ..... 52/406.2
6,141,930 A * 11/2000 Allwein et al. ..... 52/404.1
6,484,463 B1 * 11/2002 Fay ..... 52/404.4
6,551,677 B2 4/2003 Weinstein et al.
6,579,586 B1 * 6/2003 Fay et al. ..... 428/40.1
2002/0046526 A1 * 4/2002 Knauseder ..... 52/581

* cited by examiner

*Primary Examiner*—Brian E. Glessner
(74) *Attorney, Agent, or Firm*—Robert D. Touslee

(57) ABSTRACT

The facing of a faced insulation layer has Z-folded, double-folded, or single-folded lateral tabs extending the length of the facing sheet along or spaced inwardly from lateral edges of the facing sheet. Each lateral tab has multiple segments. One of the segments of each lateral tab has an adhesive thereon that can be exposed and extended beyond one of the lateral edges of the insulation layer for bonding the faced insulation layer to a framing member. Where the blanket is separable into sections, the facing has pairs of separable tabs that separate when the blanket is separated to expose surfaces of the separable tabs with adhesive thereon. The adhesive may be microencapsulated or have microencapsulated constituent(s).

75 Claims, 8 Drawing Sheets

FACING AND FACED BUILDING INSULATION

BACKGROUND OF THE INVENTION

The subject invention relates to faced building insulation, and in particular to faced building insulation, such as fibrous insulation blankets, with tabs that store out of the way for the packaging, storage, shipping and handling of the insulation to prevent damage to the tabs and that can be easily extended beyond lateral edges of the insulation or sections of the insulation when the insulation or insulation sections are installed. These tabs are provided with adhesive coated surfaces that are exposed when the tabs are extended beyond the lateral edges of the insulation or insulation sections and these adhesive coated surfaces may be used to secure the insulation or insulation sections to building framing members.

Faced insulation such as blankets of fibrous building insulation in roll or batt form are typically installed between and secured to framing members (e.g. studs and joists) located in the walls, ceilings, and floors of buildings. Currently, these faced blankets have longitudinally extending lateral tabs that may be secured to the studs by stapling. However, it has been proposed to provide these faced blankets with lateral tabs that are coated with a pressure-sensitive adhesive so that these faced blankets may be secured to the framing members of a building by pressing the pressure-sensitive adhesive coated surfaces of the tabs against the end faces of the framing members. The following patents disclose faced blankets that have longitudinally extending lateral tabs with pressure-sensitive adhesive coated surfaces for securing the faced blankets in place.

U.S. Pat. No. 2,913,104, issued to Konrad Parker on Nov. 17, 1959, discloses a fully enclosed insulation batt 14 with lateral tabs 12 having surfaces coated with a pressure-sensitive adhesive. The lateral tabs 12 are adhered to the faced sides of the insulation batt during shipment and storage and may be pressed against the faces of framing members to secure the insulation batt in place.

U.S. Pat. No. 3,307,306, issued to Robert E. Oliver on Mar. 7, 1967, discloses insulation blankets faced on one major surface. The facings on the blankets have edge portions that are coated with pressure-sensitive adhesive and used to adhere the blankets together.

U.S. Pat. No. 3,729,879, issued to Andrew T. Franklin on May 1, 1973, discloses an encapsulated insulation blanket with lateral tabs that have surfaces coated with pressure-sensitive adhesive to secure the insulation blanket to framing members. The pressure-sensitive adhesive coated surface is covered with a release strip.

U.S. Pat. No. 4,709,523, issued to Thomas B. Broderick et al on Dec. 1, 1987, discloses a faced insulation batt with one or two double-thickness lateral facing flanges that have a surface coated with pressure-sensitive adhesive. The double-thickness facing flanges, e.g. the double-thickness facing flanges 10*a* and 10*b* of FIGS. 2 to 6, are formed by folding the lateral edge portions of the facing inwardly through 180° and bonding the lateral edge portions to the inside of the facing sheet. A pressure-sensitive adhesive 14 is applied to one surface of each flange and each flange is folded inwardly through 180° and placed in contact with a release strip 16 on the inside surface of the facing sheet. The double-thickness flanges are unfolded to expose the pressure-sensitive adhesive when the faced insulation batt is installed.

SUMMARY OF THE INVENTION

The subject invention provides a facing for building insulation blankets and other forms of building insulation layers that has longitudinally extending uniquely configured tabs that store out of the way for the packaging, storage, shipping and handling of a faced insulation product. The tabs can be easily extended beyond the lateral edges of the insulation product or sections of the insulation product for the installation of the insulation product or product sections and the tabs are provided with adhesive coated surfaces that are exposed when the tabs are extended that can be used to secure the insulation product or product sections to building framing members.

In a first embodiment of the subject invention, the facing includes one or two longitudinally extending Z-folded lateral tabs that each have three segments. The intermediate segments of these Z-folded lateral tabs have an adhesive surface that can be used to secure a faced insulation product to building framing members when the lateral tabs are extended. In a second embodiment of the subject invention, the facing includes two longitudinally extending double-folded lateral tabs that each have two segments. The second or outer segments of these double-folded lateral tabs have an adhesive surface that can be used to secure a faced insulation product to building framing members when the lateral tabs are extended. In a third embodiment of the subject invention, the facing includes longitudinally extending Z-folded lateral tabs that each have three segments. The third or outermost tab segments of the lateral tabs are wider than the inner segments and have an adhesive surface that can be used to secure a faced insulation product to building framing members when the lateral tabs are extended. In a fourth embodiment of the subject invention, the facing includes longitudinally extending Z-folded lateral tabs that each have three segments. The tab segments of the lateral tabs are substantially equal in width and the third or outermost tab segments have an adhesive surface that can be used to secure a faced insulation product to building framing members when the lateral tabs are extended. In a fifth embodiment of the subject invention, the facing includes a longitudinally extending single-folded lateral tab that has a single segment. The tab has an adhesive surface that can be used to secure a faced insulation product to a building framing member when the lateral tab is extended. In a sixth embodiment of the subject invention, the facing includes a longitudinally extending single-folded lateral tab that has a single segment. The tab has an adhesive surface that can be used to secure a faced insulation product to another similarly faced insulation product for packaging, storage, shipment and handling and to building framing members when the lateral tabs of the two insulation products are separated.

To prevent damage to the lateral tabs of the facing, the lateral tabs lay substantially flat on the facing for the packaging, storage, shipping and handling of an insulation product faced with the facing. However, the lateral tabs can be quickly and easily extended beyond lateral edges of the insulation to expose adhesive coated tab surfaces for securing the faced insulation to framing members. When the facing of the subject invention is used on insulation that is separable longitudinally into insulation sections of lesser widths than the insulation, the facing may also include one or more spaced apart pairs of longitudinally extending separable tabs intermediate the lateral tabs that also lay substantially flat on the facing for the packaging, storage, shipping and handling of an insulation product faced with the facing. Each pair of separable tabs in the facing extends along the length of the insulation where the insulation is longitudinally separable into insulation sections. The separable tabs of each pair of separable tabs separate from each other when the adjoining insulation sections to which the separable tabs are secured are pulled apart. When the separable tabs are pulled apart, adhesive coated tab surfaces are exposed on each of the separable tabs that extend laterally beyond the lateral edges of the separated insulation sections for securing the insulation sections to framing members.

The subject invention also provides adhesives for securing lateral tab segments of a facing together and to framing members and for securing pairs of separable facing tabs together and to framing members. In the preferred embodiments, the adhesive on the coated adhesive surfaces of the lateral and separable tabs is: an unencapsulated pressure sensitive adhesive with the required adhesive strength to hold the lateral tab segments together and the pairs of separable tabs together for the packaging, storage, shipping and handling of the faced insulation and for securing the tabs to framing members; a base adhesive with the required adhesive strength to hold the lateral tab segments and the pairs of separable tabs together for the packaging, storage, shipping and handling of the faced insulation and that contains one or more microencapsulated pressure sensitive adhesive(s) released by rupturing (e.g. fracturing or crushing) the microcapsules to provide added adhesive strength for securing the tabs to framing members; or a base adhesive with the required adhesive strength to hold the lateral tab segments and the pairs of separable tabs together for the packaging, storage, shipping and handling of the faced insulation and that contains one or more microencapsulated additional adhesive constituent(s) released by rupturing (e.g. fracturing or crushing) the microcapsules to form, with the base adhesive and/or with one or more other released, previously microencapsulated adhesive constituents, an adhesive with the required strength for securing the tabs to framing members. The facing material may be any suitable conventional facing material such as but not limited to: kraft paper facing material, a polymeric film facing material, a foil-scrim-kraft paper facing material, nonwoven spunbond or glass mat, nonwoven spunbond or glass mat bonded to a polymeric film or other sheet material, or other facing material. While release liners can be used on the lateral tabs of any of the embodiments of the subject invention utilizing unencapsulated pressure sensitive adhesives, preferably, where unencapsulated pressure sensitive adhesives are used on the lateral tabs of any of the embodiments of the subject invention, release agents are applied to the opposing surfaces of adjacent segments of the lateral tabs thereby eliminating the need for separate release liners (e.g. strips of sheet material coated with a release agent) and the need to dispose of the release liners when they are removed from the tabs during installation.

DESCRIPTION OF THE PREFERRED EMBODIMENTS

Figure 1:
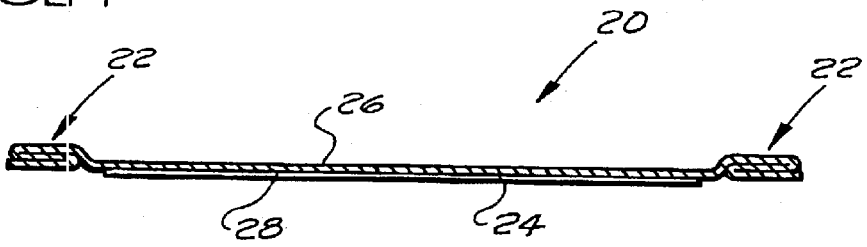
FIG. 1 is a schematic transverse cross section through a facing incorporating a first embodiment of the lateral tab of the subject invention.

The facing materials used to form the facing of the subject invention may include various sheet or paper like materials, such as but not limited to coated kraft paper, a foil-scrim-kraft laminate, polymeric film sheets, nonwoven spunbond or glass mat, nonwoven spunbond or glass mat bonded to a polymeric film, or other facing material. Preferably, the facing materials are sufficiently pliable and deformable: a) to hold a fold or crease so that when tabs are formed in the facing material, the tabs retain their shape and can be folded substantially flat against the facing or insulation and will remain folded substantially flat against the facing or insulation to prevent damage to the tabs during packaging, storage, shipment and handling; and b) to be easily unfolded or opened and extended while retaining their integrity for application to a framing member. Typically the facings are between about 0.5 mils and about 4.0 mils in thickness. Preferably, for certain applications, these facing materials exhibit a permeance of less than 1 grains/ft$^2$/hour/inch Hg (less than 1 perm) to provide a vapor retarder or barrier for the faced insulation layer, e.g. a faced resilient fibrous insulation blanket, and for other applications, these facing materials exhibit a permeance of more than 5 grains/ft$^2$/hour/inch Hg (more than 5 perm) to provide a porous facing for the faced insulation layer.

The tabs of the facing have an adhesive thereon that hold segments of the lateral tabs together or to the outer surface of the facing or insulation layer and that hold the tabs of the pairs of separable tabs together during packaging, storage, shipment and handling and that is used to secure the tab segments or tabs to framing members when the faced insulation layer, e.g. resilient fibrous insulation blankets, of the subject invention are installed. The adhesives applied to the tabs may include various adhesives such as but not limited to an unencapsulated pressure-sensitive adhesive (PSA), a base adhesive that includes therein one or more microencapsulated pressure sensitive adhesives, and a base adhesive that includes therein one or more additional microencapsulated adhesive constituents.

An example of a pressure-sensitive adhesive that may be used is a hot melt pressure-sensitive adhesive sold by Bostick Findley of Wisconsin under the trade designation 2279 hot melt pressure sensitive adhesive. The hot melt pressure-sensitive adhesive may be modified with flame retardant additives, such as but not limited to penta-bromyl and diphenyl oxide. Other examples of pressure sensitive adhesives that adhere well to both wood and metal surfaces are double stick tapes sold under the trade designations "Compac 251" and "Compac 351" by Compac Industries, Inc. of Edison, New Jersey. When needed a compatible release agent, e.g. silicone or some other conventional release agent, may be used with the pressure sensitive adhesive to facilitate the unfolding of tab segments for the extension and application of a tab segment to a framing member.

In the adhesive on the lateral tabs and/or the tabs of the pairs of separable tabs that includes a base adhesive with one or more microencapsulated pressure sensitive adhesives therein, preferably, the microencapsulated pressure sensitive adhesive is a conventional, commercially available water based pressure sensitive adhesive and the base adhesive is a conventional, commercially available adhesive that has sufficient adhesive strength to hold the tab segments or tabs together for packaging, storage, shipment and handling. When the microcapsules of pressure sensitive adhesive(s) are ruptured, e.g. through the application of pressure or by being pulled apart, to secure the tab segments or tabs to framing members, the resulting adhesive has greater adhesive strength than the base adhesive to better bond the tab segments or tabs to the framing members.

In the adhesive on the lateral tabs or the tabs of the pairs of separable tabs that includes a base adhesive with one or more additional microencapsulated adhesive constituents, preferably, the microencapsulated adhesive constituents are conventional commercially available adhesive constituents and the base adhesive is a conventional, commercially available adhesive that has sufficient adhesive strength to hold the tab segments or tabs together for packaging, storage, shipment and handling. When the microcapsules of the one or more additional adhesive constituent(s) are ruptured, e.g. through the application of pressure or by being pulled apart, to secure the tab segments or tabs to framing members, the resulting adhesive formed from the base adhesive and the one or more adhesive constituents released from the microcapsules or from the adhesive constituents released from the microcapsules, has greater adhesive strength than the base adhesive to better bond the tab segments or tabs to the framing members.

Preferably, the pressure-sensitive adhesive, the adhesive formed from the base adhesive and one or more released microencapsulated pressure-sensitive adhesives, and the adhesive formed from the base adhesive and the one or more released microencapsulated adhesive constituents or formed from the released microencapsulated adhesive constituents, permit the tab segments or tabs to be removed from and repositioned, if necessary, on the framing members for at least a limited period of time, e.g. 30 seconds before the adhesive sets up. Preferably, the adhesives used on the tab segments or tabs adhere well to both wooden and metal framing members to form a good seal between the tab segments or tabs and the framing members and to help hold the faced insulation layers in place until sheathing, paneling, wallboard, or other wall forming sheets or boards are installed. While the adhesives of the subject invention are especially well suited for use with the preferred facings of the subject invention, the adhesives of the subject invention may also be used with other facings having various different lateral tab configurations, e.g. such as the double thickness lateral facing flanges of U.S. Pat. No. 4,709,523, and various different separable tab configurations.

While the facings of the subject invention are especially well suited for facing a fibrous blanket of building insulation, such as but not limited to a resilient glass fiber insulation blanket, the facings of the subject invention may be used to face other types of building insulation layers, such as but not limited to foam insulation layers, sheets or sheathing; multi-layer radiant barrier insulations such as those manufactured by Fi-Foil Company of Auburndale, Fla.; and other types of insulation layers, sheets or sheathing.

Figure 2:
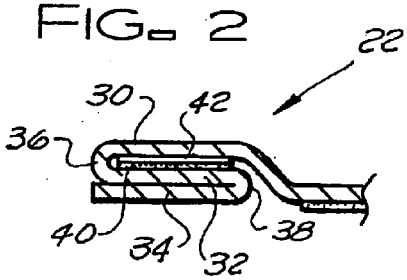
FIG. 2 is an enlarged schematic partial transverse cross section through a lateral edge portion of the facing of FIG. 1 with a lateral tab of the facing in a folded state.
Figure 3:
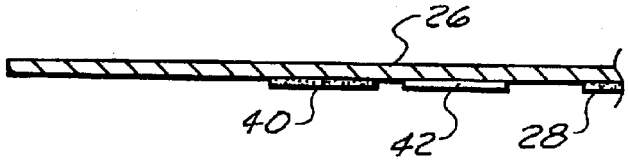
FIG. 3 is an enlarged schematic transverse cross section through the lateral tab of FIG. 2 with the lateral tab in an unfolded and extended state.

FIGS. 1 to 3 schematically illustrate a first facing 20 for facing a major surface of an insulation layer that incorporates a first embodiment of the lateral tab of the subject invention. The facing sheet 20 has Z-folded lateral tabs 22 along lateral edges of the facing sheet that extend the length of the facing sheet. The facing sheet 20 has a length and a width, with the Z-folded tabs in a folded state, which is substantially equal to the length and width of the major surface of the insulation layer to be faced with the facing sheet 20. The facing sheet 20 has two major surfaces 24 and 26. The major surface 24 of the facing sheet 20 to be applied and bonded to a major surface of an insulation layer has an adhesive 28 thereon (e.g. a hot melt adhesive, a water based adhesive, etc.) for bonding the facing sheet to the major surface of the insulation layer. The adhesive 28 for bonding the facing sheet 20 to the major surface of an insulation layer is only located on a barrier portion of the facing sheet that is intermediate the Z-folded tabs and does not directly bond the Z-folded tabs to the major surface of the insulation layer. The adhesive for bonding the facing sheet 20 to a major surface of an insulation layer may be applied to the major surface 24 of the facing sheet as a continuous layer 28 as shown in FIG. 1; in a pattern, e.g. as stripes or dots; a web; etc.

As shown in FIG. 2, each Z-folded lateral tab 22 has first, second and third segments 30, 32 and 34. The first segment 30 of each lateral tab 22 is joined to the second segment 32 of each lateral tab along a first fold line 36 and the second segment 32 of each lateral tab is joined to the third segment 34 of each lateral tab along a second fold line 38. The first segment 30 of each lateral tab 22 overlays the second segment 32 of each lateral tab and the second segment 32 of each lateral tab overlays the third segment 34 of each lateral tab which is to rest on the major surface of the insulation layer to which the facing sheet 20 is bonded. The surface of the second segment 32 of each lateral tab 22 that is overlaid by the first segment 30 of each lateral tab having an adhesive 40 (an adhesive of the subject invention described above) thereon whereby when the third segment 34 of either of the lateral tabs 22 is pulled laterally outward the first and second segments 30 and 32 of that lateral tab 22 are pulled apart as shown in FIG. 3 to expose the surface of the second segment 32 of that lateral tab having the adhesive 40 thereon for application to a framing member. To facilitate the separation of the first and second segments 30 and 32 when the third segment 34 is pulled laterally outward, a release agent 42 may be present on the surface of the first segment 30 of each lateral tab 22 that overlays the surface of the second segment with the adhesive 40 thereon. The adhesive 40 and the release agent 42 may be continuous or patterned coating layers.

Figure 4:
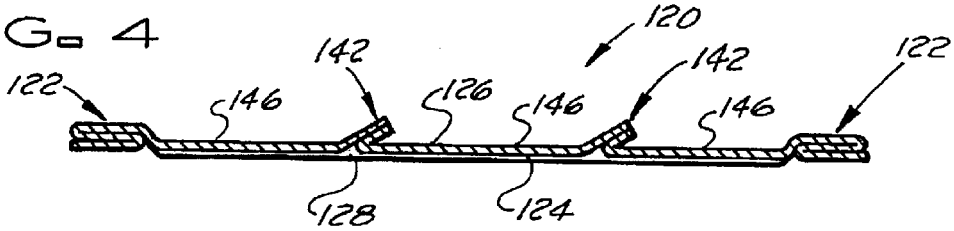
FIG. 4 is a schematic transverse cross section through a first facing that is longitudinally separable into sections and that incorporates the first embodiment of the lateral tab of the subject invention.
Figure 5:
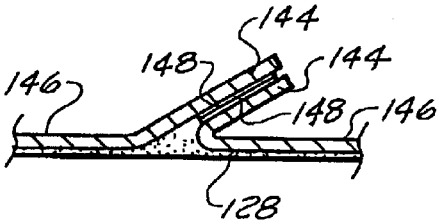
FIG. 5 is an enlarged schematic transverse cross section through a pair of separable tabs of the facing of FIG. 4.
Figure 6:
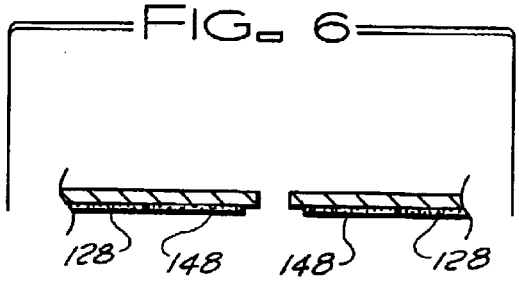
FIG. 6 is a schematic transverse cross section through the pair of separable tabs of FIG. 5 after the tabs have been unfolded and pulled apart.

FIGS. 4 to 6 schematically illustrate a second facing 120 for facing a major surface of an insulation layer that incorporates the first embodiment of the lateral tab of the subject invention. The facing sheet 120 has Z-folded lateral tabs 122 along lateral edges of the facing sheet that extend the length of the facing sheet. The facing sheet 120 has a length and a width, with the Z-folded tabs in a folded state, which is substantially equal to the length and width of the major surface of the insulation layer to be faced with the facing sheet 120. The facing sheet 120 has two major surfaces 124 and 126. The major surface 124 of the facing sheet 120 to be applied and bonded to a major surface of an insulation layer has an adhesive 128 thereon (e.g. a hot melt adhesive, a water based adhesive, etc.) for bonding the facing sheet to the major surface of the insulation layer. The adhesive 128 for bonding the facing sheet to the major surface of an insulation layer is only located on a barrier portion of the facing sheet that is intermediate the Z-folded tabs and does not directly bond the Z-folded tabs to the major surface of the insulation layer. The adhesive for bonding the facing sheet 120 to a major surface of an insulation layer may be applied to the first major surface 124 of the facing sheet as a continuous layer 128 as shown in FIG. 4, in a pattern, e.g. as stripes or dots, a web, etc.

Each Z-folded lateral tab 122 is the same as and functions the same as the Z-folded lateral tabs 22 of facing 20. Accordingly, to avoid repetition, the Z-folded lateral tabs 122 of facing 120 will not be described again in detail. The facing 120 is intended for use with longitudinally separable insulation layers such as but not limited to pre-cut fibrous insulation layers that can be separated longitudinally into insulation sections of lesser widths than the pre-cut insulation layer. To be used with such pre-cut separable insulation layers, the facing 120 must be separable where the pre-cut insulation layer is separable and provide tabs for securing the insulation sections to framing members and maintain the perm rating of the facing whatever that perm rating may be.

The facing sheet 120 is provided with one or more pairs 142 of longitudinally extending separable tabs 144 that extend for the length of the facing sheet 120. Each pair 142 of separable tabs is spaced inwardly from the lateral edges and Z-folded lateral tabs 122 of the facing sheet 120 and is spaced laterally from any other pair 142 of separable tabs on the facing sheet. Each pair 142 of separable tabs extends from the second major surface 126 of the facing sheet 120. The facing sheet 120 is made of two or more narrower sheets 146 of facing material. Each of the separable tabs 144 is formed by a lateral edge portion of one of narrower sheets 146 of facing material and each of the separable tabs 144 has an unexposed surface with an adhesive layer 148 thereon that separably bonds the tabs 144 and the sheets 146 together as schematically shown in FIG. 5. The pair of separable tabs 144 are separable from each other when pulled apart by hand to longitudinally separate the facing sheet 120 into two pieces and to expose the surfaces of the pair of separable tabs 144 having the adhesive 148 thereon as shown in FIG. 6. The adhesive 148 may be any of the adhesives of the subject invention discussed above and the adhesive 148 may be the same as or differ from the adhesive 40 used on the Z-folded lateral tabs 122. For example, since the adhesive layers 148 on the separable tabs 144 are bonded to each other rather than to a surface with a release agent, the adhesive 148 may have less adhesion than the adhesive 40 used on the Z-folded lateral tabs 122 to facilitate the separation of the separable tabs 144. A preferred adhesive for the adhesive layers 148 is a pressure sensitive adhesive referred to in the industry as a "removable" pressure sensitive adhesive such as the pressure sensitive adhesive used by Minnesota, Mining and Manufacturing Company on its Post-it® pop-up notes.

Figure 7:
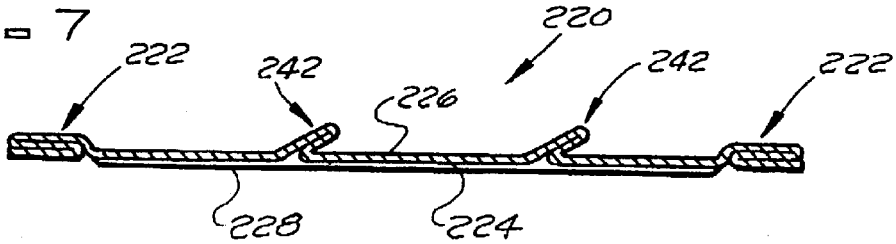
FIG. 7 is a schematic transverse cross section through a second facing that is longitudinally separable into sections and that incorporates the first embodiment of the lateral tab of the subject invention.
Figure 8:
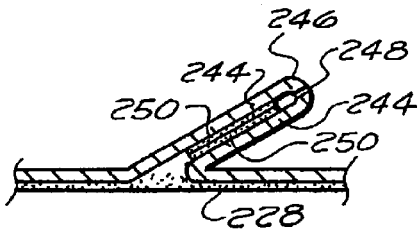
FIG. 8 is an enlarged schematic transverse cross section through a pair of separable tabs of the facing of FIG. 7.
Figure 9:
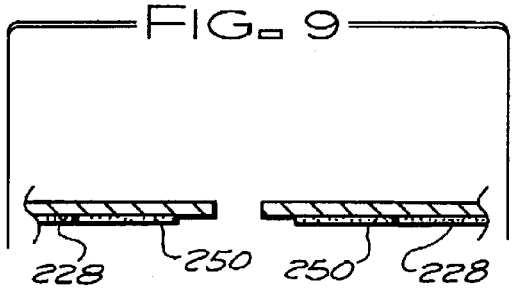
FIG. 9 is a schematic transverse cross section through the pair of separable tabs of FIG. 8 after the tabs have been unfolded and pulled apart.

FIGS. 7 to 9 schematically illustrate a third facing 220 for facing a major surface of an insulation layer that incorporates the first lateral tab of the subject invention. The facing sheet 220 has Z-folded lateral tabs 222 along lateral edges of the facing sheet that extend the length of the facing sheet. The facing sheet 220 has a length and a width, with the Z-folded tabs in a folded state, which is substantially equal to the length and width of the major surface of the insulation layer to be faced with the facing sheet 220. The facing sheet 220 has two major surfaces 224 and 226. The major surface 224 of the facing sheet 220 to be applied and bonded to a major surface of an insulation layer has an adhesive 228 thereon (e.g. a hot melt adhesive, a water based adhesive, etc.) for bonding the facing sheet to the major surface of the insulation layer. The adhesive 228 for bonding the facing sheet 220 to the major surface of an insulation layer is located only on a barrier portion the facing sheet that is intermediate the Z-folded tabs and does not directly bond the Z-folded tabs to the major surface of the insulation layer. The adhesive for bonding the facing sheet 220 to a major surface of an insulation layer may be applied to the major surface 224 of the facing sheet as a continuous layer 228 as shown in FIG. 4, in a pattern, e.g. as stripes or dots, a web, etc.

Each Z-folded lateral tab 222 is the same as and functions the same as the Z-folded lateral tabs 22 of facing 20. Accordingly, to avoid repetition, the Z-folded lateral tabs 222 of facing 220 will not be described again in detail. The facing 220 is intended for use with separable insulation layers such as pre-cut fibrous insulation layers that can be separated longitudinally into insulation sections of lesser widths than the pre-cut insulation layer. To be used with such pre-cut separable insulation layers, the facing 220 must be separable where the pre-cut insulation layer is separable and provide tabs for securing the insulation sections to framing members and maintaining the perm rating of the facing whatever that perm rating may be.

The facing sheet 220 is provided with one or more pairs 242 of longitudinally extending separable tabs 244 that extend for the length of the facing sheet 220. Each pair 242 of separable tabs 244 is spaced inwardly from the lateral edges and Z-folded lateral tabs 222 of the facing sheet 220 and is spaced laterally from any other pair 242 of separable tabs on the facing sheet. Each pair 242 of separable tabs extends from the second major surface 226 of the facing sheet 220 and is formed by a fold in the facing sheet 220. The separable tabs 244 are separable from each other along a common fold line 246 that, preferably, has a series of perforations 248 or is otherwise weakened along its length. Each of the separable tabs 244 has an unexposed surface with an adhesive layer 250 thereon that separably bonds the tabs 244 together as schematically shown in FIG. 8. The pair of separable tabs 244 are separable from each other when pulled apart by hand to longitudinally separate the facing sheet 220 into two pieces and to expose the surfaces of the pair of separable tabs 244 having the adhesive 250 thereon as shown in FIG. 9. The adhesive 250 may be any of the adhesives of the subject invention discussed above and the adhesive 250 may be the same as or differ from the adhesive 40 used on the Z-folded lateral tabs 222. For example, since the adhesive layers 250 on the separable tabs 244 are bonded to each other rather than to a surface with a release agent, the adhesive 250 may have less adhesion than the adhesive 40 used on the Z-folded lateral tabs 222 to facilitate the separation of the separable tabs 244. A preferred adhesive for the adhesive layers 250 is a pressure sensitive adhesive referred to in the industry as a "removable" pressure sensitive adhesive such as the pressure sensitive adhesive used by Minnesota, Mining and Manufacturing Company on its Post-it® pop-up notes.

While as discussed above, the insulation layers faced with the facings of the subject invention may be made of other materials, preferably the insulation layers are resilient fibrous insulation blankets and, preferably, the faced conventional uncut resilient fibrous insulation blankets and the faced pre-cut resilient fibrous insulation blankets of the subject invention are made of randomly oriented, entangled, glass fibers and typically have a density between about 0.3 pounds/ft$^3$ and about 1.6 pounds/ft$^3$. Examples of fibers other than glass fibers that may be used to form the faced resilient insulation blankets of the subject invention are mineral fibers, such as but not limited to, rock wool fibers, slag fibers, and basalt fibers, and organic fibers such as but not limited to polypropylene, polyester and other polymeric fibers. The fibers in the faced resilient insulation blankets of the subject invention may be bonded together for increased integrity, e.g. by a binder at their points of intersection such as but not limited to urea phenol formaldehyde or other suitable bonding materials, or the faced resilient fibrous insulation blankets of the subject invention may be binderless provided the blankets possess the required integrity and resilience.

While the faced resilient fibrous insulation blankets of the subject invention may be in roll form (typically in excess of 117 inches in length), for most applications, such as the insulation of walls in homes and other residential structures, the faced resilient fibrous insulation blankets of the subject invention are in the form of batts about 46 to about 59 inches in length (typically about 48 inches in length) or 88 to about 117 inches in length (typically about 93 inches in length). Typically, the widths of the faced resilient fibrous insulation blankets are substantially equal to or somewhat greater than standard cavity width of the cavities to be insulated, for example: about 15 to about 15½ inches in width (a nominal width of 15 inches) for a cavity where the center to center spacing of the wall, floor, ceiling or roof framing members is about 16 inches (the cavity having a width of about 14 2/2 inches); and about 23 to about 23½ inches in width (a nominal width of 23 inches) for a cavity where the center to center spacing of the wall, floor, ceiling or roof framing members is about 24 inches (the cavity having a width of about 22½ inches). However, for other applications, the faced resilient fibrous insulation blankets may have different initial widths determined by the standard widths of the cavities to be insulated by the insulation blankets.

The amount of thermal resistance or sound control desired and the depth of the cavities being insulated determine the thicknesses of the faced resilient fibrous insulation blankets of the subject invention. Typically, the faced resilient fibrous insulation blankets are about three to about ten or more inches in thickness and approximate the depth of the cavities being insulated. For example, in a wall cavity defined in part by nominally 2×4 or 2×6 inch studs or framing members, a pre-cut resilient fibrous insulation blanket will have a thickness of about 3½ inches or about 5½ inches, respectively.

Due to the resilience of the fibrous insulation blankets and way the facing tabs are stored to prevent damage to the facing tabs, the faced resilient fibrous insulation blankets of the subject invention can be compressed to reduce the blankets in thickness for packaging. When the pre-cut resilient fibrous insulation blankets are removed from the insulation package, the blankets recover to substantially their pre-compressed thicknesses. However, the resilience of the pre-cut resilient fibrous insulation blankets provides another very important benefit. After a full width resilient fibrous insulation blanket or a reduced width resilient fibrous insulation blanket formed from section(s) of a full width pre-cut resilient fibrous insulation blanket is compressed in width and inserted into a cavity having a width somewhat less than the width of the full width pre-cut resilient fibrous insulation blanket or reduced width resilient fibrous insulation blanket, the full width pre-cut resilient fibrous insulation blanket or reduced width resilient fibrous insulation blanket will expand laterally to the width of the cavity and press against the sides of the cavity to help hold the pre-cut resilient fibrous insulation blanket or reduced width resilient fibrous insulation blanket in place.

Since in preferred embodiments of the subject invention resilient fibrous insulation blankets form the insulation layers faced with the facings of the subject invention, the faced insulation layers of the subject invention will be described in detail with respect to faced fibrous insulation blankets. However, the facings of the subject invention may be used to face any of insulation layers discussed above.

Figure 10:
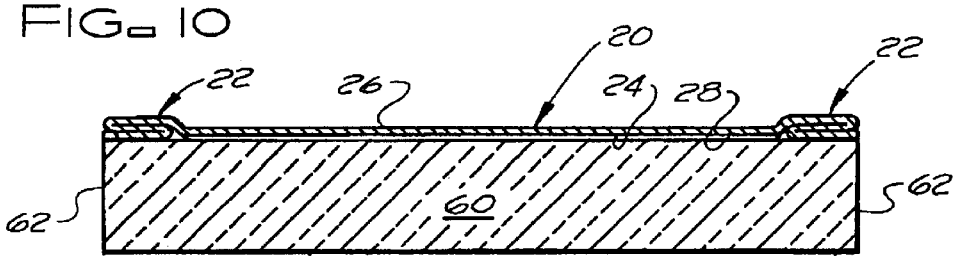
FIG. 10 is a schematic transverse cross section through a fibrous insulation blanket that is faced with a facing incorporating the first embodiment of the lateral tab of the subject invention. The fibrous insulation blanket is faced with the facing of FIG. 1.
Figure 11:
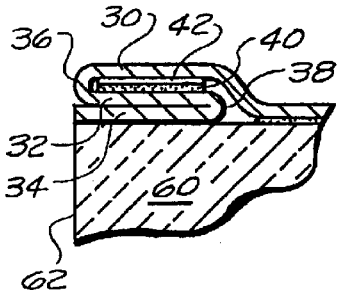
FIG. 11 is an enlarged schematic partial transverse cross section through a lateral edge portion of the faced fibrous insulation blanket of FIG. 10 with a lateral tab of the facing in a folded state.
Figure 12:
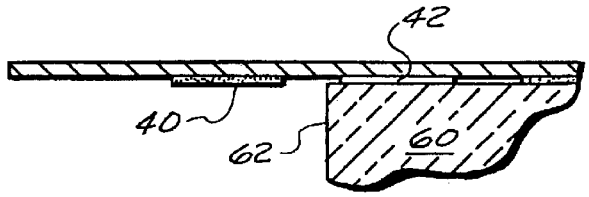
FIG. 12 is an enlarged schematic partial transverse cross section through a lateral edge portion of the faced fibrous insulation blanket of FIG. 10 with a lateral tab of facing in an unfolded and extended state.

FIGS. 10 to 12 illustrate the facing sheet 20 of FIGS. 1 to 3 bonded to a major surface of a resilient fibrous insulation blanket 60. The facing sheet 20 has Z-folded lateral tabs 22 along lateral edges of the facing sheet that extend the length of the facing sheet. The facing sheet 20 has a length and a width, with the Z-folded tabs in a folded state, which is substantially equal to the length and width of the major surface of the fibrous insulation blanket 60. The facing sheet 20 has two major surfaces 24 and 26. The major surface 24 of the facing sheet 20 has an adhesive layer 28 thereon (e.g. a hot melt adhesive, water based adhesive, etc.) that bonds the facing sheet to the major surface of the fibrous insulation blanket. The adhesive layer 28 that bonds the facing sheet to the major surface of a fibrous insulation blanket is only located on a barrier portion of the facing sheet that is intermediate the Z-folded tabs 22 and does not directly bond the Z-folded tabs which rest on the major surface of the fibrous insulation blanket to the major surface of the fibrous insulation blanket. The adhesive layer 28 for bonding the facing sheet 20 to a major surface of a fibrous insulation blanket may be a continuous layer as shown in FIG. 10, in a pattern, e.g. as stripes or dots, a web, etc.

Each Z-folded lateral tab 22 has first, second and third segments 30, 32 and 34. The first segment 30 of each lateral tab 22 is joined to the second segment 32 of each lateral tab along a first fold line 36 and the second segment 32 of each lateral tab is joined to the third segment 34 of each lateral tab along a second fold line 38. In its folded state, the first segment 30 of each lateral tab 22 overlays the second segment 32 of each lateral tab and the second segment 32 of each lateral tab overlays the third segment 34 of each lateral tab which rests on the major surface of the fibrous insulation blanket 60 but preferably does not extend laterally beyond the lateral surfaces 62 of the fibrous insulation blanket. The surface of the second segment 32 of each lateral tab 22 that is overlaid by the first segment 30 of each lateral tab has an adhesive 40 (an adhesive of the subject invention described above) thereon whereby when the third segment 34 of either of the lateral tabs 22 is pulled laterally outward the first and second segments 30 and 32 of that lateral tab 22 are pulled apart as shown in FIG. 12 to expose the surface of the second segment 32 of that lateral tab having the adhesive 40 thereon laterally beyond the lateral surface 62 of the blanket for application to a framing member. A release agent 42 may be present on the surface of the first segment 30 of each lateral tab 22 that overlays the surface of the second segment with the adhesive 40 thereon to facilitate the separation of the first and second segments 30 and 32 when the third segment 34 is pulled laterally outward. The adhesive 40 and the release agent 42 may be continuous or patterned coating layers.

The preferred faced pre-cut resilient fibrous insulation blanket of the subject invention includes a plurality of longitudinally extending blanket sections formed in the resilient fibrous insulation blanket by a plurality of longitudinally extending cut and separable connector arrangements located intermediate the blanket sections of the resilient fibrous insulation blanket and spaced laterally from each other and laterally inward from the lateral edges of the resilient fibrous insulation blanket. The separable connectors of the cut and separable connector arrangements separably join the adjacent blanket sections of the pre-cut resilient fibrous insulation blanket along the length of the resilient fibrous insulation blanket to hold the resilient fibrous insulation blanket together for handling and installation while being separable by hand to permit selective separation of adjacent blanket sections to form a reduced width resilient fibrous insulation blanket of a desired or selected width.

Preferably, the fibrous insulation materials used to form the faced pre-cut resilient fibrous insulation blankets of the subject invention, whether made of glass or other fibers, are sufficiently resilient to close longitudinally extending cuts (partial cuts) made in the fibrous insulation blanket that both: a) divide the blanket into longitudinally extending blanket sections of selected widths and lengths; and b) by not completely severing the blanket between adjacent blanket sections, form separable connectors within the blanket separably joining adjacent blanket sections. With this structure, the cuts in the faced pre-cut resilient fibrous insulation blankets of the subject invention do not form thermal bridges in the direction of the thickness of the blanket (perpendicular to the major surfaces of the blanket) that would adversely affect the thermal and/or acoustical performance or other properties of the faced pre-cut resilient fibrous insulation blanket.

Figure 13:
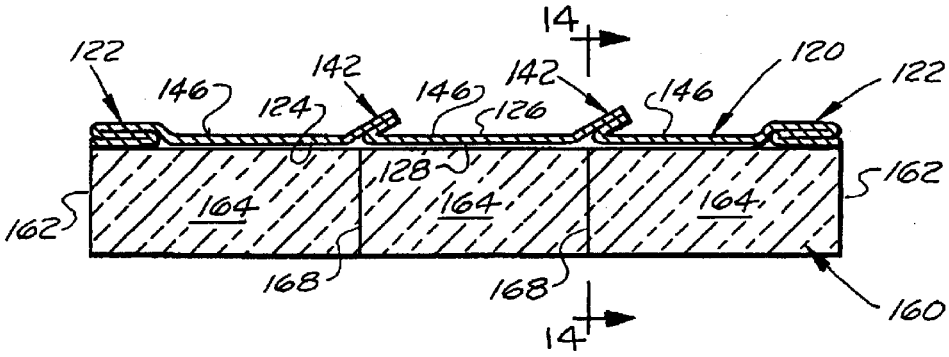
FIG. 13 is a schematic transverse cross section through a fibrous insulation blanket that is separable into blanket sections. The fibrous insulation blanket is faced with the facing of FIG. 4.

FIGS. 13 to 16 illustrate the facing sheet 120 of FIGS. 4 to 6 bonded to a major surface of a resilient pre-cut fibrous insulation blanket 160. The facing sheet 120 has Z-folded lateral tabs 122 along lateral edges of the facing sheet that extend the length of the facing sheet. With the Z-folded tabs 122 in a folded state, the facing sheet 120 has a length and a width that are substantially equal to the length and width of the major surface of the fibrous insulation blanket 160 and, preferably, the Z-folded tabs 122 do not extend beyond the lateral surfaces 162 of the blanket. The facing sheet 120 has two major surfaces 124 and 126. The major surface 124 of the facing sheet 120 has an adhesive layer 128 thereon (e.g. a hot melt adhesive, a water based adhesive, etc.) that bonds the facing sheet to the major surface of the fibrous insulation blanket 160. The adhesive layer 128 bonding the facing sheet 120 to the major surface of a fibrous insulation blanket is only located on a barrier portion of the facing sheet that is intermediate the Z-folded tabs 122 and does not directly bond the Z-folded tabs 122 to the major surface of the fibrous insulation blanket. The adhesive layer 128 that bonds the facing sheet 120 to a major surface of a fibrous insulation blanket may be a continuous layer as shown in FIG. 13, in a pattern, e.g. as stripes or dots, a web, etc.

Figure 14:
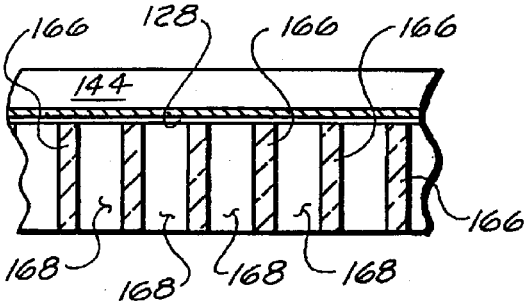
FIG. 14 is a schematic partial longitudinal cross section through the fibrous insulation blanket of FIG. 13 taken substantially along lines 14—14 of FIG. 13.

Each Z-folded lateral tab 122 is the same as and functions the same as the Z-folded lateral tabs 22 of facing 20. Accordingly, to avoid repetition, the Z-folded lateral tabs 122 of facing 120 will not be described again in detail. The pre-cut fibrous insulation blanket 160 can be separated longitudinally by hand into blanket sections 164 of lesser widths than the pre-cut fibrous insulation blanket. As schematically shown in FIG. 14, the blanket sections 164 are joined together by a series of separable connectors 166 formed in the blanket by a series of partial cuts 168 that extend completely through the blanket but are separated by the separable connectors 166.

Figure 15:
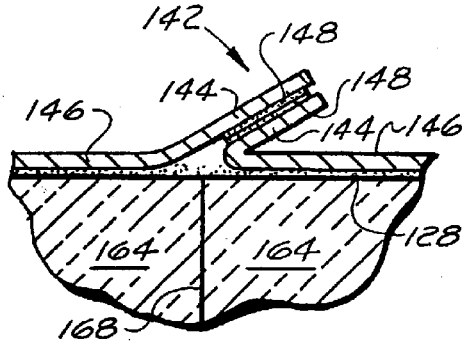
FIG. 15 is an enlarged schematic partial transverse cross section through a midportion of the faced fibrous insulation blanket of FIG. 13 with a pair of separable tabs of the facing in a folded state.
Figure 16:
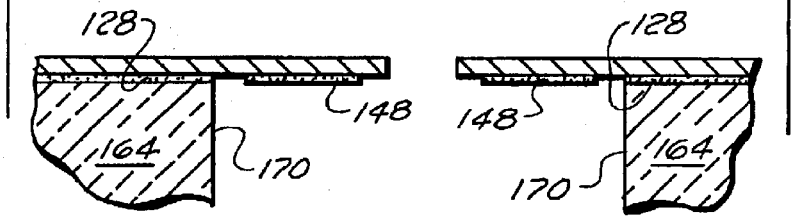
FIG. 16 is an enlarged schematic partial transverse cross section through the fibrous insulation blanket of FIG. 13 after adjacent blanket sections of the faced fibrous insulation blanket have been separated and the pair of separable tabs of FIG. 15 have been unfolded, extended and separated.

The facing sheet 120 is provided with one or more pairs 142 of longitudinally extending separable tabs 144 that extend for the length of the facing sheet 120. These pairs 142 of separable tabs 144 enable the facing 120 to be separable by hand where the pre-cut fibrous insulation blanket 160 is separable and provide tabs for securing blanket sections 164 to framing members. Each pair 142 of separable tabs is spaced inwardly from the lateral edges and Z-folded lateral tabs 122 of the facing sheet 120, is spaced laterally from any other pair 142 of separable tabs on the facing sheet, and is longitudinally aligned with a series of partial cuts and separable connectors in the blanket. Each pair 142 of separable tabs extends from the second major surface 126 of the facing sheet 120. The facing sheet 120 is made of two or more narrower sheets 146 of facing material. Each of the separable tabs 144 is formed by a lateral edge portion of one of narrower sheets 146 of facing material and each of the separable tabs 144 has an unexposed surface with an adhesive layer 148 thereon that separably bonds the tabs 144 and the sheets 146 together as schematically shown in FIG. 15. When the pre-cut fibrous insulation blanket 160 is separated by hand into blanket sections 164, the pair of separable tabs 144 are longitudinally separable from each other at the same location to longitudinally separate the facing sheet 120 and to expose the surfaces of the pair of separable tabs 144 having the adhesive 148 thereon beyond the lateral surfaces 170 of the blanket sections 164 as shown in FIG. 16 for application to framing members. The adhesive 148 may be any of the adhesives of the subject invention discussed above and the adhesive 148 may be the same as or differ from the adhesive 40 used on the Z-folded lateral tabs 122. For example, since the adhesive layers 148 on the separable tabs 144 are bonded to each other rather than to a surface with a release agent, the adhesive 148 may have less adhesion than the adhesive 40 used on the Z-folded lateral tabs 122 to facilitate the separation of the separable tabs 144. A preferred adhesive for the adhesive layers 148 is a pressure sensitive adhesive referred to in the industry as a "removable" pressure sensitive adhesive such as the pressure sensitive adhesive used by Minnesota, Mining and Manufacturing Company on its Post-it® pop-up notes.

Figure 17:
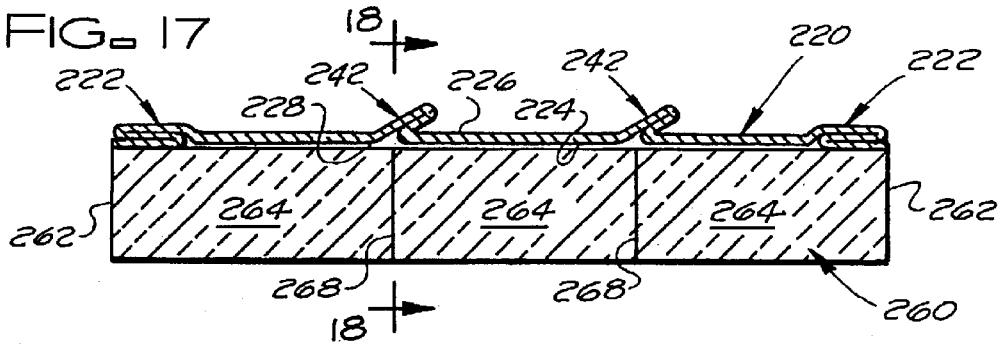
FIG. 17 is a schematic transverse cross section through a fibrous insulation blanket that is separable into blanket sections. The fibrous insulation blanket is faced with the facing of FIG. 7.

FIGS. 17 to 20 illustrate the facing sheet 220 of FIGS. 7 to 9 bonded to a major surface of a resilient pre-cut fibrous insulation blanket 260. The facing sheet 220 has Z-folded lateral tabs 222 along lateral edges of the facing sheet that extend the length of the facing sheet. With the Z-folded tabs 222 in a folded state, the facing sheet 220 has a length and a width that are substantially equal to the length and width of the major surface of the fibrous insulation blanket 260 and, preferably, the Z-folded tabs 222 do not extend beyond the lateral surfaces 262 of the blanket. The facing sheet 220 has two major surfaces 224 and 226. The major surface 224 of the facing sheet 220 has an adhesive layer 228 thereon (e.g. a hot melt adhesive, a water based adhesive, etc.) that bonds the facing sheet to the major surface of the fibrous insulation blanket 260. The adhesive layer 228 that bonds the facing sheet 220 to the major surface of a fibrous insulation blanket is only located on a barrier portion of the facing sheet intermediate the Z-folded tabs 222 and does not directly bond the Z-folded tabs 222 to the major surface of the fibrous insulation blanket. The adhesive layer 228 bonding the facing sheet 220 to a major surface of a fibrous insulation blanket may be a continuous layer as shown in FIG. 17, in a pattern, e.g. as stripes or dots, a web, etc.

Figure 18:
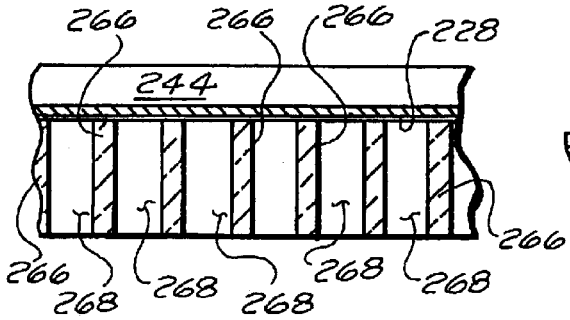
FIG. 18 is a schematic partial longitudinal cross section through the fibrous insulation blanket of FIG. 17 taken substantially along lines 18—18 of FIG. 17.

Each Z-folded lateral tab 222 is the same as and functions the same as the Z-folded lateral tabs 22 of facing 20. Accordingly, to avoid repetition, the Z-folded lateral tabs 222 of facing 220 will not be described again in detail. The pre-cut fibrous insulation blanket 260 can be separated longitudinally by hand into blanket sections 264 of lesser widths than the pre-cut fibrous insulation blanket. As schematically shown in FIG. 18, the blanket sections 264 are joined together by a series of separable connectors 266 formed in the blanket by a series of partial cuts 268 that extend completely through the blanket but are separated by the separable connectors 266.

Figure 19:
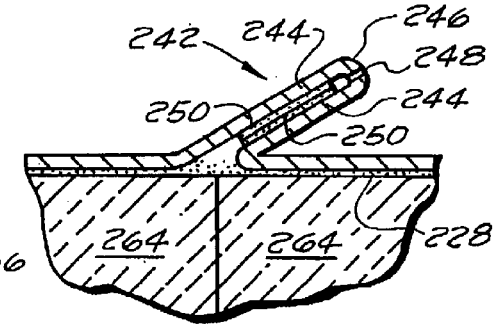
FIG. 19 is an enlarged schematic partial transverse cross section through a midportion of the faced fibrous insulation blanket of FIG. 17 with a pair of separable tabs of the facing in a folded state.
Figure 20:
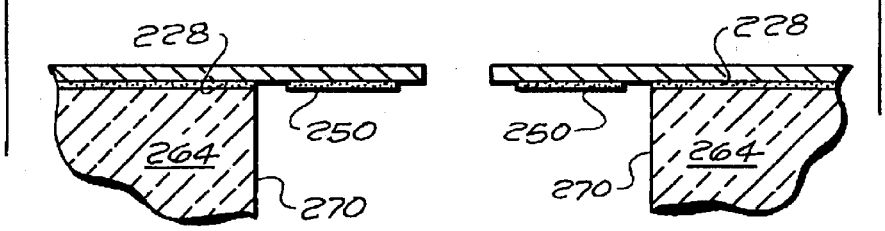
FIG. 20 is an enlarged schematic partial transverse cross section through the fibrous insulation blanket of FIG. 17 after adjacent blanket sections of the faced fibrous insulation blanket have been separated and the pair of separable tabs of FIG. 19 have been unfolded, extended and separated.

The facing sheet 220 is provided with one or more pairs 242 of longitudinally extending separable tabs 244 that extend for the length of the facing sheet 220. These pairs 242 of separable tabs 244 enable the facing 220 to be separated by hand where the pre-cut fibrous insulation blanket 260 is separable and provide tabs for securing blanket sections 264 to framing members. Each pair 242 of separable tabs is spaced inwardly from the lateral edges and Z-folded lateral tabs 222 of the facing sheet 220, is spaced laterally from any other pair 242 of separable tabs on the facing sheet, and is longitudinally aligned with a series of partial cuts and separable connectors in the blanket. Each pair 242 of separable tabs extends from the second major surface 226 of the facing sheet 220 and is formed by a fold in the facing sheet 220. The separable tabs 244 are separable from each other along a common fold line 246 that, preferably, has a series of perforations 248 or is otherwise weakened. Each of the separable tabs 244 has an unexposed surface with an adhesive layer 250 thereon that separably bonds the tabs 244 together as schematically shown in FIG. 19. When the pre-cut fibrous insulation blanket 260 is separated by hand into blanket sections 264, the pair of separable tabs 244 are longitudinally separated from each other at the same location to longitudinally separate the facing sheet 220 and to expose the surfaces of the pair of separable tabs 244 having the adhesive 250 thereon beyond the lateral surfaces 270 of the blanket sections 264 as shown in FIG. 20 for application to framing members. The adhesive 250 may be any of the adhesives of the subject invention discussed above and the adhesive 250 may be the same as or differ from the adhesive 40 used on the Z-folded lateral tabs 222. For example, since the adhesive layers 250 on the separable tabs 244 are bonded to each other rather than to a surface with a release agent, the adhesive 250 may have less adhesion than the adhesive 40 used on the Z-folded lateral tabs 222 to facilitate the separation of the separable tabs 244. A preferred adhesive for the adhesive layers 250 is a pressure sensitive adhesive referred to in the industry as a "removable" pressure sensitive adhesive such as the pressure sensitive adhesive used by Minnesota, Mining and Manufacturing Company on its Post-it® pop-up notes.

Figure 21:
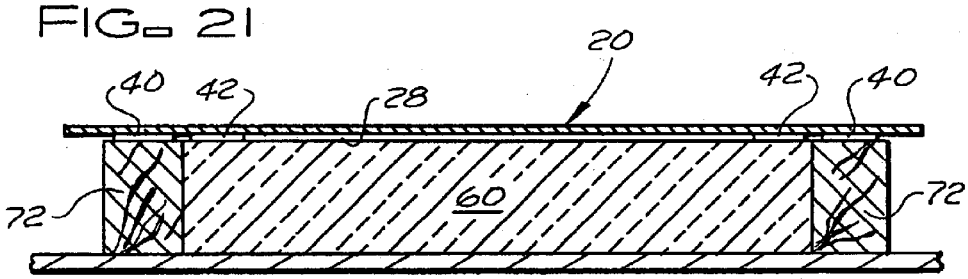
FIG. 21 is a schematic transverse cross section of the fibrous insulation blanket of FIG. 10 installed between two framing members.

FIG. 21 shows the faced resilient fibrous insulation blanket 60 of FIG. 10 installed between two framing members 72 in a wall, floor, ceiling or roof. As shown, the adhesive 40 on the second segments 32 of the lateral tabs 22 bonds the second segments of the lateral tabs to the end faces of the framing members 72 to form a seal between the facing 20 and framing members and to form, with the remainder of the facing sheet 20, a vapor retarding layer or barrier between the framing members 72. While as shown, the second and third segments 32 and 34 of the lateral tabs 22 have been unfolded from each other, the second and third segments 32 and 34 may remain in their initial folded state when the second segment 32 is unfolded from the first segment 30 to apply and adhere the second segment 32 to framing members.

Figure 22:
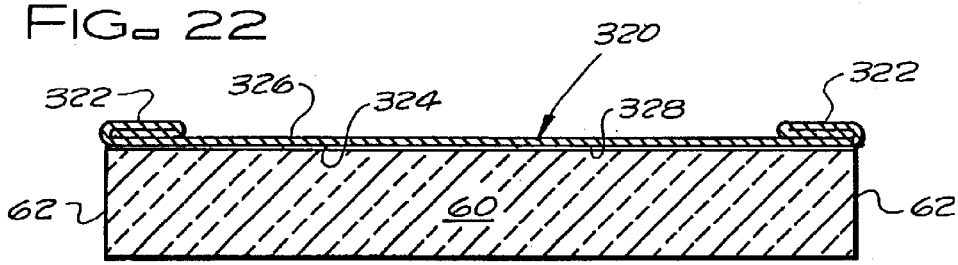
FIG. 22 is a schematic transverse cross section through a fibrous insulation blanket that is faced with a facing incorporating a second embodiment of the lateral tab of the subject invention.

FIGS. 22 to 25 illustrate a facing sheet 320 incorporating a second embodiment of the lateral tab of the subject invention bonded to a major surface of a resilient fibrous insulation blanket 60. The facing sheet 320 has double-folded lateral tabs 322 along lateral edges of the facing sheet that extend the length of the facing sheet. The facing sheet 320 has a length and a width, with the double-folded tabs in a folded state, which is substantially equal to the length and width of the major surface of the fibrous insulation blanket 60. The facing sheet 320 has two major surfaces 324 and 326. The major surface 324 of the facing sheet 320 has an adhesive layer 328 thereon (e.g. a hot melt adhesive, water based adhesive, etc.) that bonds the facing sheet to the major surface of the fibrous insulation blanket. The adhesive layer 328 that bonds the facing sheet to the major surface of a fibrous insulation blanket may extend the entire width of the barrier portion of the facing sheet and fibrous insulation blanket. The adhesive layer 328 bonding the facing sheet 320 to a major surface of a fibrous insulation blanket may be a continuous layer as shown in FIG. 22, in a pattern, e.g. as stripes or dots, a web, etc.

Figure 23:
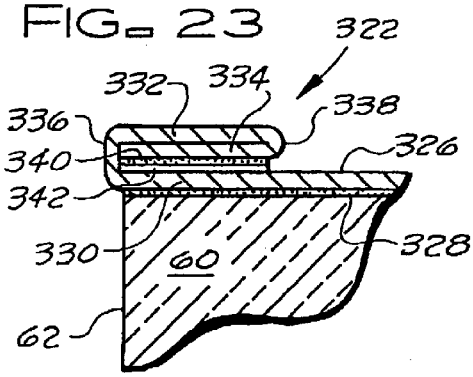
FIG. 23 is an enlarged schematic partial transverse cross section through a lateral edge portion of the faced fibrous insulation blanket of FIG. 22 with a lateral tab of the facing in a folded state.
Figure 24:
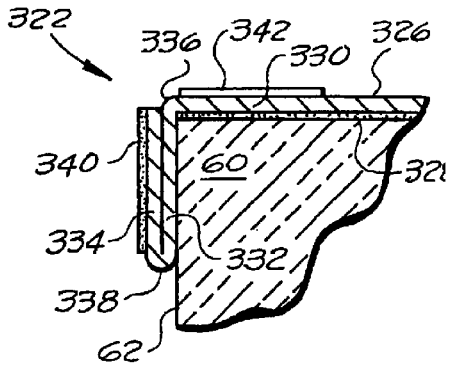
FIG. 24 is an enlarged schematic partial transverse cross section through the lateral edge portion of the faced fibrous insulation blanket of FIG. 22 with a lateral tab of facing in an unfolded and extended state.

In its stored folded state, each double-folded lateral tab 322 is folded back upon the upper surface 326 of the facing sheet 322 and preferably, does not extend beyond the lateral edges of the insulation blanket 60. Each double folded lateral tab 322 has first, second and third segments 330, 332 and 334 that, preferably, are about equal in width. The first segment 330 of each lateral tab 322 is a lateral edge portion of the barrier portion of the facing sheet 320 that overlays the major surface of the fibrous insulation blanket 60. The first segment 330 of the lateral tab 322 is joined to the second segment 332 along a first fold line 336. The second segment 332 of each lateral tab is joined to the third segment 334 of the tab along a second fold line 338. As best shown in FIG. 23, when the double-folded lateral tab 322 is in its folded and stored state, the second segment 332 of each lateral tab 322 overlays the third segment 334 of each lateral tab and the third segment 334 of each lateral tab overlays and rests on the first segment 330 of the lateral tab. The surface of the third segment 332 of each lateral tab 322 that overlays and opposes the first segment 330 of the lateral tab has an adhesive 340 (an adhesive of the subject invention described above) thereon whereby when the double-folded tab 322 is unfolded from the upper surface of the first segment 330 along fold line 336 and extended along a lateral surface 62 of the fibrous insulation blanket 60 as shown in FIG. 24, the adhesive 340 is exposed to secure the faced fibrous insulation blanket 60 to a framing member. A release agent 342 may be present on the outer surface 326 of the first segment 330 of the lateral tab 322 to facilitate the separation of second and third sections the double-folded tab 322 from the first section 330 of the lateral tab when the double-folded tab is unfolded along fold line 336 and extended along the lateral surface of the faced fibrous insulation blanket. The adhesive 340 and the release agent 342 may be continuous or patterned coating layers.

Figure 25:
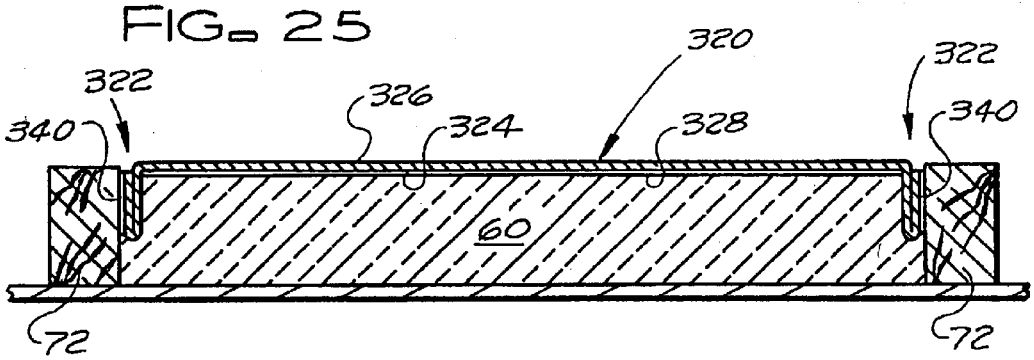
FIG. 25 is a schematic transverse cross section of the fibrous insulation blanket of FIG. 22 installed between two framing members.

FIG. 25 shows the faced resilient fibrous insulation blanket of FIG. 22 installed between two framing members 72 in a wall, floor, ceiling or roof. As shown, the adhesive 340 on the third segments 334 of the lateral tabs 322 bonds the third segments of the lateral tabs 322 to the lateral faces of the framing members 72 to form a seal between the facing 320 and framing members and to form, with the remainder of the facing sheet 320, a vapor retarding layer or barrier between the framing members 72. Since the second and third segments 332 and 334 of the lateral tabs 322 are not bonded together and are joined along the fold line 338, an installer can insert his/her fingers between the second and third segments 332 and 334 of the lateral tabs 322 while installing the faced fibrous insulation blanket to press the adhesive coated surfaces of the third segments 334 into contact with the lateral surfaces of the framing members 72 to thereby easily form a good seal between the facing 320 and the lateral surfaces of the framing members 72.

While FIGS. 22 to 25 show the second embodiment of the lateral tab, the double folded lateral tab 322, on a facing such as the facing 20 of FIG. 1 which has no pairs of separable tabs, the double folded lateral tab 322 of FIGS. 22 to 25 can be substituted for the lateral tabs 122 on the facing 120 or the lateral tabs 222 on the facing 220 and used to face separable insulation such as the separable resilient pre-cut fibrous insulation blankets 160 of FIGS. 13 to 16 and 260 of FIGS. 17 to 20. Other than the substitution of the lateral tabs 322 for the lateral tabs 122 and 222, the separable facings utilizing the lateral tabs 322 would be the same as the separable facings 120 and 220.

FIGS. 26 to 29 show a facing sheet 420 incorporating a third embodiment 422 of the lateral tab of the subject invention bonded to a major surface of a resilient fibrous insulation blanket 60. The facing sheet 420 includes two Z-folded lateral tabs 422 and a barrier sheet 424 that overlays a major surface of the resilient fibrous insulation blanket 60. The barrier sheet 424 has two major surfaces 426 and 428. The two Z-folded lateral tabs 422 extend along lateral edges of the barrier sheet 424 for the length of the barrier sheet 424 and are bonded to the major surface 428 of the barrier sheet 424, e.g. by an adhesive layer 430 (e.g. a hot melt adhesive, water based adhesive, etc.).

The facing sheet 420 has a length and a width, with the Z-folded lateral tabs 422 in a folded state, which is substantially equal to the length and width of the major surface of the fibrous insulation blanket 60. The major surface 426 of the barrier sheet 424 has an adhesive layer 432 thereon (e.g. a hot melt adhesive, water based adhesive, etc.) that bonds the facing sheet 420 to the major surface of the fibrous insulation blanket 60. The adhesive layer 432 that bonds the facing sheet 420 to the major surface of a fibrous insulation blanket 60 may be a continuous layer that extends the entire width of the facing sheet 420 as shown in FIG. 26, or the adhesive layer 432 may be in a pattern, e.g. stripes or dots, a web, etc.

Figure 27:
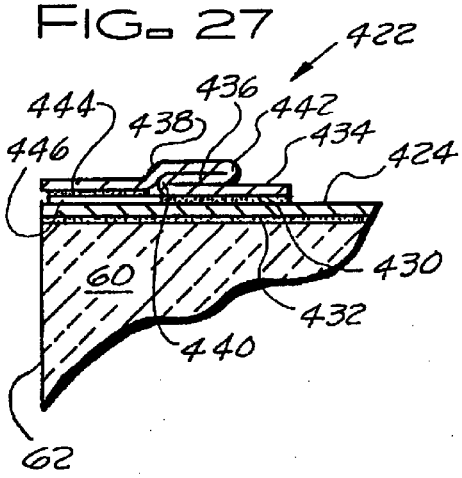
FIG. 27 is an enlarged schematic partial transverse cross section through a lateral edge portion of the faced fibrous insulation blanket of FIG. 26 with a lateral tab of the facing in a folded state.
Figure 28:
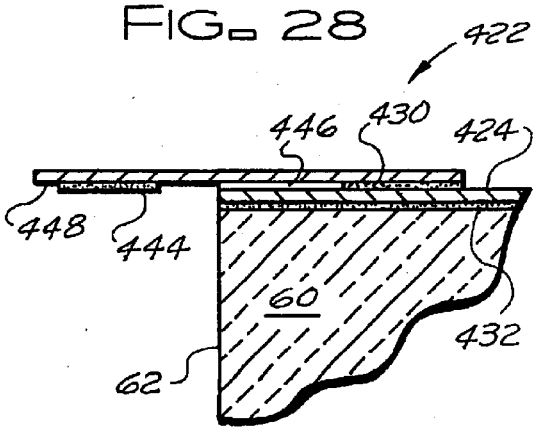
FIG. 28 is an enlarged schematic partial transverse cross section through the lateral edge portion of the faced fibrous insulation blanket of FIG. 26 with a lateral tab of facing in an unfolded and extended state.

As shown in FIG. 27, each Z-folded lateral tab 422 has first, second and third segments 434, 436 and 438. The first segment 434 of each lateral tab 422 is joined to the second segment 436 of each lateral tab along a first fold line 440 and the second segment 436 of each lateral tab is joined to the third segment 438 of each lateral tab along a second fold line 442. The first segment 434 of each lateral tab 422 overlays and is bonded to the barrier sheet 424 by the adhesive layer 430. The first segment 434 of the lateral tab 422 is spaced inwardly from the adjacent lateral edge of the barrier sheet 424 and thus the adjacent lateral edge of the major surface of the resilient fibrous insulation blanket 60. The second segment 436 of each lateral tab 422 overlays the first segment 434 of each lateral tab and, preferably has a width about equal to or slightly greater than one half of the spacing of the first segment 434 of the lateral tab from the lateral edge of the barrier sheet 424. By having the width of the second segment 436 of the lateral tab about equal to or more than one half the spacing of the first segment 434 of the lateral tab from the lateral edge of the barrier sheet 424, when the Z-folded lateral tab 422 is unfolded and extended, the third segment 438 of the lateral tab will project laterally beyond the lateral surface 62 of the insulation blanket as shown in FIG. 28 for application to a framing member.

The third segment 438 of the lateral tab 422 overlays the second segment 436 of the lateral tab and extends laterally beyond the second segment 436 to overlay part or all of that portion of the barrier sheet 424 between the first segment 434 of the lateral tab 422 and the adjacent lateral edge of the barrier sheet 424. Preferably, with the lateral tab 422 in its folded state, the third segment 438 of the Z-folded tab 422 does not extend laterally beyond the lateral edge of the barrier sheet 424 or the lateral surface 62 of the fibrous insulation blanket. A surface of that portion of the third segment 438 of the lateral tab 422 that extends laterally beyond the second segment 436 of the lateral tab has an adhesive 444 (an adhesive of the subject invention described above) thereon separably bonding the third segment of the lateral tab to that portion of the barrier sheet portion of the facing sheet between the first segment of the lateral tab 422 and the adjacent lateral edge of the barrier sheet portion of the facing sheet whereby when the third segment 438 of the lateral tab 422 is pulled laterally outward to unfold the Z-folded tab 422, the portion of the surface of the third segment 438 with the adhesive 444 thereon extends laterally beyond the lateral surface 62 of the blanket for application to a framing member. A release agent 446 may be present on the surface 426 of the barrier sheet 424 that is overlaid by the adhesive 444 on the third segment of the lateral tab to facilitate the separation of the third segment 438 of the lateral tab from the barrier sheet 424 when the third segment 438 is pulled laterally outward. The adhesive 444 and the release agent 446 may be continuous or patterned coating layers. The adhesive 444 on the third segment 438 of the lateral tab 422 may be spaced inwardly from the outer lateral edge of the third segment 438 to provide a flap 448 that may be more easily grasped and pulled to unfold the Z-folded lateral tab 422. This flap 448 may extend beyond the lateral edge of the barrier sheet 424.

Figure 26:
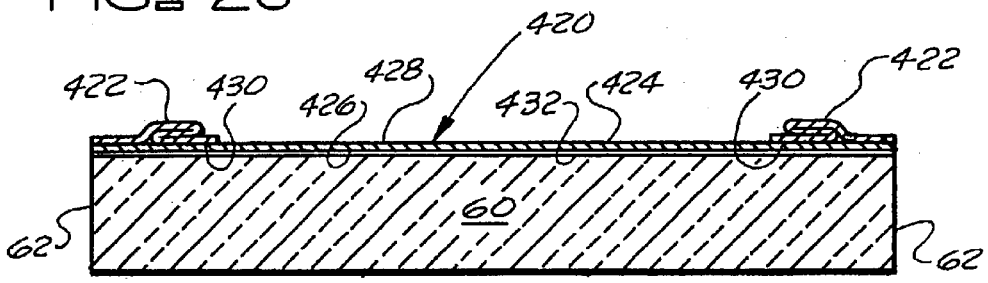
FIG. 26 is a schematic transverse cross section through a fibrous insulation blanket that is faced with a facing incorporating a third embodiment of the lateral tab of the subject invention.
Figure 29:
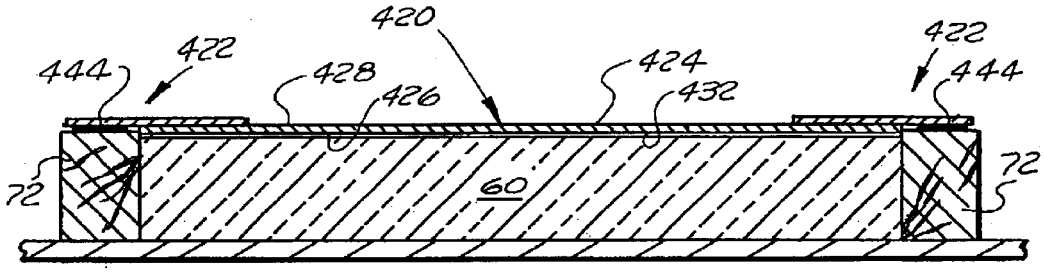
FIG. 29 is a schematic transverse cross section of the fibrous insulation blanket of FIG. 26 installed between two framing members.

FIG. 29 shows the faced resilient fibrous insulation blanket of FIG. 26 installed between two framing members 72 in a wall, floor, ceiling or roof. As shown, the adhesive 444 on the third segments 438 of the lateral tabs 422 bonds the third segments of the lateral tabs 422 to the end faces of the framing members 72 to form a seal between the facing sheet 420 and framing members and to form, with the remainder of the facing sheet 420, a vapor retarding layer or barrier between the framing members 72.

While FIGS. 26 to 29 show the third embodiment of the lateral tab, the Z-folded lateral tab 422, on a facing such as the facing 20 of FIG. 1 which has no pairs of separable tabs, the Z-folded lateral tab 422 of FIGS. 26 to 29 can be substituted for the lateral tabs 122 on the facing 120 or the lateral tabs 222 on the facing 220 and used to face separable insulation such as the separable resilient pre-cut fibrous insulation blankets 160 of FIGS. 13 to 16 and 260 of FIGS. 17 to 20. Other than the substitution of the lateral tabs 422 for the lateral tabs 122 and 222, the separable facings utilizing the lateral tabs 422 would be the same as the separable facings 120 and 220.

FIGS. 30 to 33 show a facing sheet 520 incorporating a fourth embodiment 522 of the lateral tab of the subject invention bonded to a major surface of a resilient fibrous insulation blanket 60. The facing sheet 520 includes two Z-folded lateral tabs 522 that are integral with a barrier portion 524 of facing sheet that overlays a major surface of the resilient fibrous insulation blanket 60. The barrier portion 524 of the facing sheet has two major surfaces 526 and 528. The two Z-folded lateral tabs 522 extend along lateral edges of the barrier portion 524 of the facing sheet for the length of the barrier sheet 524.

The facing sheet 520 has a length and a width, with the Z-folded lateral tabs 522 in a folded state, which is substantially equal to the length and less than the width of the major surface of the fibrous insulation blanket 60. The major surface 526 of the barrier sheet 524 has an adhesive layer 530 thereon (e.g. a hot melt adhesive, water based adhesive, etc.) that bonds the facing sheet 520 to the major surface of the fibrous insulation blanket 60. The adhesive layer 530 that bonds the facing sheet 520 to the major surface of a fibrous insulation blanket 60 may be a continuous layer that extends the entire width of the facing sheet 520 as shown in FIG. 30, or the adhesive layer 530 may be in a pattern, e.g. stripes or dots, a web, etc.

Figure 31:
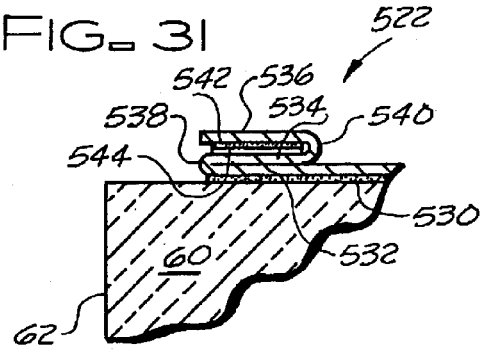
FIG. 31 is an enlarged schematic partial transverse cross section through a lateral edge portion of the faced fibrous insulation blanket of FIG. 30 with a lateral tab of the facing in a folded state.
Figure 32:
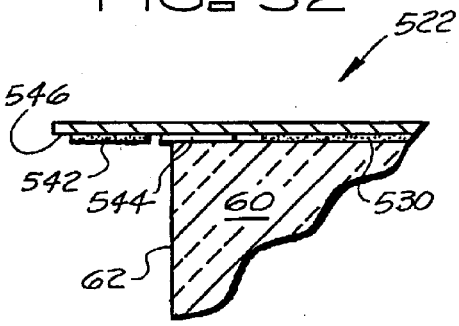
FIG. 32 is an enlarged schematic partial transverse cross section through the lateral edge portion of the faced fibrous insulation blanket of FIG. 30 with a lateral tab of facing in an unfolded and extended state.

As shown in FIG. 31, each Z-folded lateral tab 522 has first, second and third segments 532, 534 and 536. The first segment 532 of each lateral tab 522 is joined to the second segment 534 of each lateral tab along a first fold line 538 and the second segment 534 of each lateral tab is joined to the third segment 536 of each lateral tab along a second fold line 540. The first segment 532 of each lateral tab 522 is a lateral edge portion of the barrier portion 524 of the facing sheet 520. With the Z-folded lateral tab 522 in its folded state, the fold line 538 joining the first segment 532 and the second segment 534 of the lateral tab 522 is at the lateral edge of the facing sheet 520 and is spaced inwardly from the adjacent lateral edge of the major surface of the resilient fibrous insulation blanket 60. The second segment 534 of each lateral tab 522 overlays the first segment 532 of each lateral tab and, preferably has a width about equal to or slightly greater than the spacing of the first segment 532 of the lateral tab from the lateral edge of the major surface of the resilient fibrous insulation blanket 60. By having the width of the second segment 534 of the lateral tab about equal to or more than the spacing of the first segment 532 of the lateral tab from the lateral edge of the major surface of the resilient fibrous insulation blanket 60, when the Z-folded lateral tab 522 is unfolded and extended, the third segment 536 of the lateral tab will project laterally beyond the lateral surface 62 of the insulation blanket 60 as shown in FIG. 32 for application to a framing member.

The third segment 536 of the lateral tab 522 overlays the second segment 534 of the lateral tab and typically is substantially the same width as the width of the second segment 534. With the lateral tab 522 in its folded state, the third segment 536 of the Z-folded tab 522 does not extend laterally beyond the lateral surface 62 of the fibrous insulation blanket 60. A surface of the third segment 536 of the lateral tab 522 that overlays the second segment 534 of the lateral tab has an adhesive 542 (an adhesive of the subject invention described above) thereon separably bonding the third segment to the second segment whereby when the third segment 536 of the lateral tab 522 is pulled laterally outward to unfold the Z-folded tab 522, the surface of the third segment 536 with the adhesive 542 thereon extends laterally beyond the lateral surface 62 of the blanket for application to a framing member. A release agent 544 may be present on the surface of the second segment 534 of the lateral tab 522 opposing the surface of the third segment of the lateral tab with the adhesive 542 thereon to facilitate the separation of the third segment 536 of the lateral tab from the second segment 534 of the lateral tab 522 when the third segment 536 is pulled laterally outward. The adhesive 542 and the release agent 544 may be continuous or patterned coating layers. The adhesive 542 on the third segment 536 of the lateral tab 522 may be spaced inwardly from the outer lateral edge of the third segment 536 to provide a flap 546 that may be more easily grasped and pulled to unfold the Z-folded lateral tab 522. This flap 546 may extend beyond the lateral edge of the barrier sheet 524.

Figure 30:
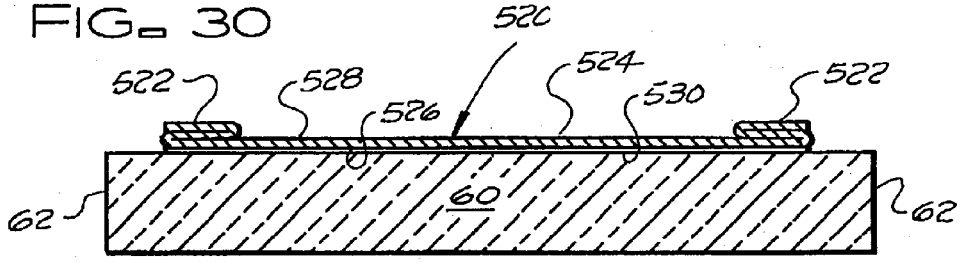
FIG. 30 is a schematic transverse cross section through a fibrous insulation blanket that is faced with a facing incorporating a fourth embodiment of the lateral tab of the subject invention.
Figure 33:
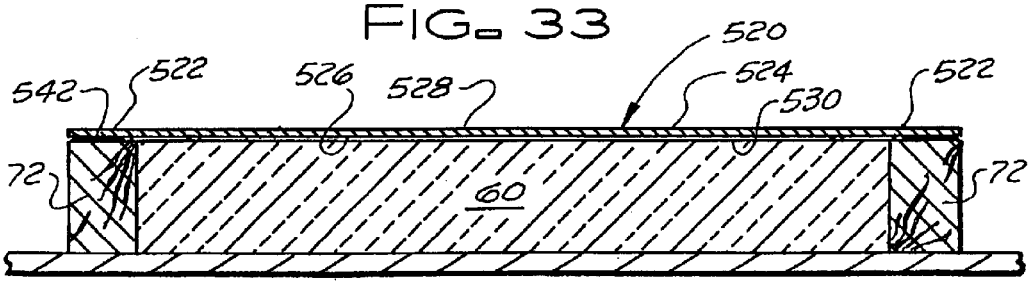
FIG. 33 is a schematic transverse cross section of the fibrous insulation blanket of FIG. 30 installed between two framing members.

FIG. 33 shows the faced resilient fibrous insulation blanket of FIG. 30 installed between two framing members 72 in a wall, floor, ceiling or roof. As shown, the adhesive 542 on the third segments 536 of the lateral tabs 522 bonds the third segments of the lateral tabs 522 to the end faces of the framing members 72 to form a seal between the facing sheet 520 and framing members and to form, with the remainder of the facing sheet 520, a vapor retarding layer or barrier between the framing members 72.

While FIGS. 30 to 33 show the fourth embodiment of the lateral tab, the Z-folded lateral tab 522, on a facing such as the facing 20 of FIG. 1 which has no pairs of separable tabs, the Z-folded lateral tab 522 of FIGS. 30 to 33 can be substituted for the lateral tabs 122 on the facing 120 or the lateral tabs 222 on the facing 220 and used to face separable insulation such as the separable resilient pre-cut fibrous insulation blankets 160 of FIGS. 13 to 16 and 260 of FIGS. 17 to 20. Other than the substitution of the lateral tabs 522 for the lateral tabs 122 and 222, the separable facings utilizing the lateral tabs 522 would be the same as the separable facings 120 and 220.

FIGS. 34 to 38 show a facing sheet 620 incorporating a fifth embodiment 622 of the lateral tab of the subject invention bonded to a major surface of a resilient fibrous insulation blanket 60. The facing sheet 620 includes one single-folded lateral tab 622 that is integral with a barrier sheet 624 that overlays a major surface of the resilient fibrous insulation blanket 60. The barrier sheet 624 has two major surfaces 626 and 628. The one single-folded lateral tab 622 extends along one lateral edge of the barrier sheet 624 for the length of the barrier sheet 624.

The facing sheet 620 has a length and a width, with the single-folded lateral tab 622 in a folded state, which is substantially equal to the length and the width of the major surface of the fibrous insulation blanket 60. The major surface 626 of the barrier sheet 624 has an adhesive layer 630 thereon (e.g. a hot melt adhesive, water based adhesive, etc.) that bonds the facing sheet 620 to the major surface of the fibrous insulation blanket 60. The adhesive layer 630 that bonds the facing sheet 620 to the major surface of a fibrous insulation blanket 60 may be a continuous layer that extends the entire width of the facing sheet 620 as shown in FIG. 34, or the adhesive layer 630 may be in a pattern, e.g. stripes or dots, a web, etc.

Figure 35:
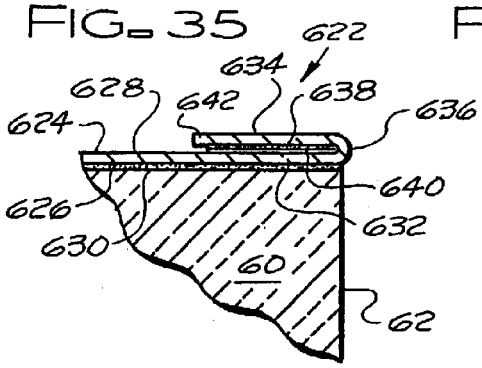
FIG. 35 is an enlarged schematic partial transverse cross section through a lateral edge portion of the faced fibrous insulation blanket of FIG. 34 with the lateral tab of the facing in a folded state.
Figure 36:
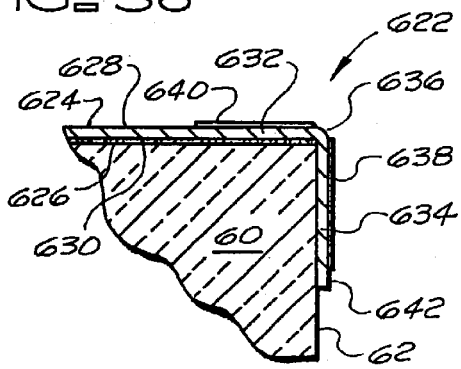
FIG. 36 is an enlarged schematic partial transverse cross section through the lateral edge portion of the faced fibrous insulation blanket of FIG. 34 with the lateral tab of facing in an unfolded and extended state.

The single-folded lateral tab 622 has first and second segments 632 and 634 with the second segment 634 folded back over the first segment 632 as shown in FIG. 35. The first segment 632 of the lateral tab 622 is joined to the second segment 634 of the lateral tab along a fold line 636. The first segment 632 of the lateral tab 622 is a lateral edge portion of the barrier sheet 624. With the single-folded lateral tab 622 in its folded state, the fold line 636 joining the first segment 632 and the second segment 634 of the lateral tab 622 is the lateral edge of the facing sheet 620 and is located at or adjacent a lateral edge of the major surface of the resilient fibrous insulation blanket 60. The second segment 634 of the lateral tab 622 overlays the first segment 632 of each lateral tab. A surface of the second segment 634 of the lateral tab 622 that overlays and opposes the first segment 632 of the lateral tab has an adhesive 638 (an adhesive of the subject invention described above) thereon whereby when the lateral tab 622 is unfolded and the second segment 634 of the lateral tab 622 is pulled laterally outward, the second segment 634 of the lateral tab can be extended along the lateral surface 62 of the blanket with the adhesive 638 facing outward as shown in FIG. 36 for application to a lateral surface of a framing member. A release agent 640 may be present on the surface of the first segment 632 of the lateral tab 622 opposing the surface of the second segment of the lateral tab with the adhesive 638 thereon to facilitate the separation of the second segment 634 of the lateral tab from the first segment 632 of the lateral tab 622 when the second segment 634 is pulled laterally outward. The adhesive 638 and the release agent 640 may be continuous or patterned coating layers. The adhesive 638 on the second segment 634 of the lateral tab 522 may be spaced inwardly from the free lateral edge of the second segment 634 to provide a flap 642 that may be more easily grasped and pulled to unfold the single-folded lateral tab 622.

Figure 34:
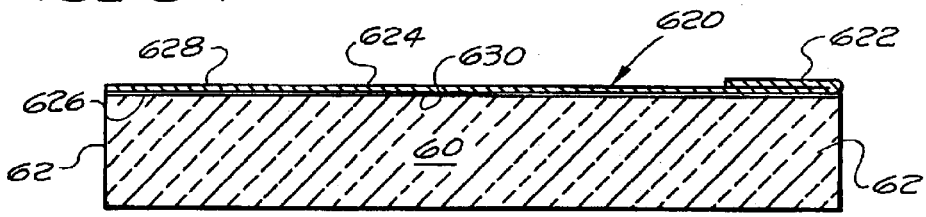
FIG. 34 is a schematic transverse cross section through a fibrous insulation blanket that is faced with a facing incorporating a fifth embodiment of the lateral tab of the subject invention.
Figure 37:
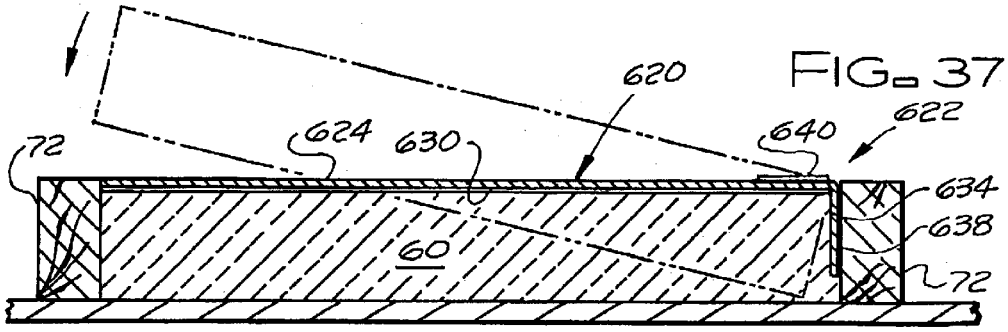
FIG. 37 is a schematic transverse cross section of the fibrous insulation blanket of FIG. 34 being installed between two framing members.

FIG. 37 shows the faced resilient fibrous insulation blanket of FIG. 34 installed between two framing members 72 in a wall, floor, ceiling or roof. As shown, the adhesive 638 on the second segment 634 of the lateral tab 622 bonds the second segment of the lateral tab 622 to the lateral face of the framing member 72 to form a seal between the facing sheet 620 and framing member and to form, with the remainder of the facing sheet 620, a vapor retarding layer or barrier between the framing members 72. The faced resilient fibrous insulation blanket of FIG. 34 is installed by first adhering the second segment 634 of the lateral tab 622 to the lateral side of one of the framing members 72 while the faced resilient fibrous insulation blanket is in the position shown in phantom line in FIG. 37. Then, the faced resilient insulation blanket is pivoted about the adhered lateral tab 622 to insert the opposite side of the faced resilient fibrous insulation blanket between the framing members 72. Typically, the faced resilient fibrous insulation blanket, when not compressed laterally, is wider than the spacing between the framing members 72 so that the faced insulation blanket can be held in place by its resilience.

Figure 38:
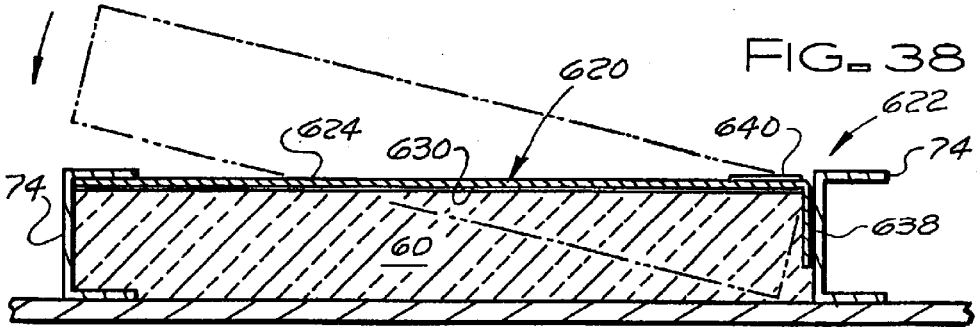
FIG. 38 is a schematic transverse cross section of the fibrous insulation blanket of FIG. 34 being installed between two channel shaped framing members.

FIG. 38 shows the faced resilient fibrous insulation blanket of FIG. 34 installed between two channel shaped framing members 74 in a wall, floor, ceiling or roof. As shown, the adhesive 638 on the second segment 634 of the lateral tab 622 bonds the second segment of the lateral tab 622 to the lateral face of one of the framing members 74 to form a seal between the facing sheet 620 and framing member and to form, with the remainder of the facing sheet 620, a vapor retarding layer or barrier between the framing members 74. The faced resilient fibrous insulation blanket of FIG. 34 is installed by first adhering the second segment 634 of the lateral tab 622 to the lateral side of the one framing member 74 while the faced resilient fibrous insulation blanket is in the position shown in phantom line in FIG. 38. Then, the faced resilient insulation blanket is pivoted about the adhered lateral tab 622 and flexed to insert the opposite side of the faced resilient fibrous insulation blanket into the channel of the other framing member and the faced resilient fibrous insulation blanket between the framing members 74.

While FIGS. 34 to 38 show the fifth embodiment of the lateral tab, the single-folded lateral tab 622, on a facing such as the facing 20 of FIG. 1 which has no pairs of separable tabs, the single-folded lateral tab 622 of FIGS. 34 to 38 can be substituted for the lateral tabs 122 on the facing 120 or the lateral tabs 222 on the facing 220 and used to face separable insulation such as the separable resilient pre-cut fibrous insulation blankets 160 of FIGS. 13 to 16 and 260 of FIGS. 17 to 20. Other than the substitution of the lateral tab 622 for the lateral tabs 122 and 222, the separable facings utilizing the lateral tab 622 would be the same as the separable facings 120 and 220.

Figure 39:
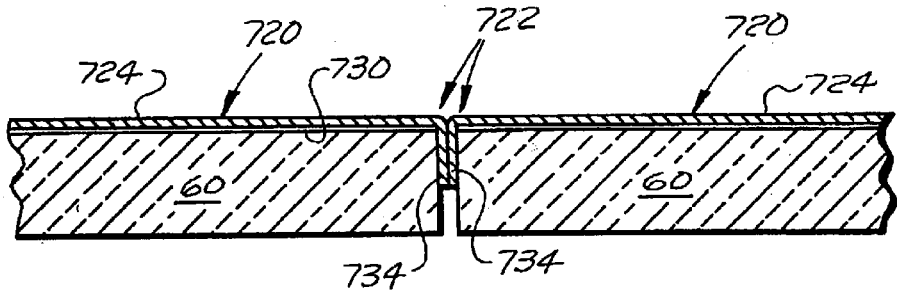
FIG. 39 is a partial schematic transverse cross section through a pair fibrous insulation blankets that are faced with a facing incorporating a sixth embodiment of the lateral tab of the subject invention.
Figure 40:
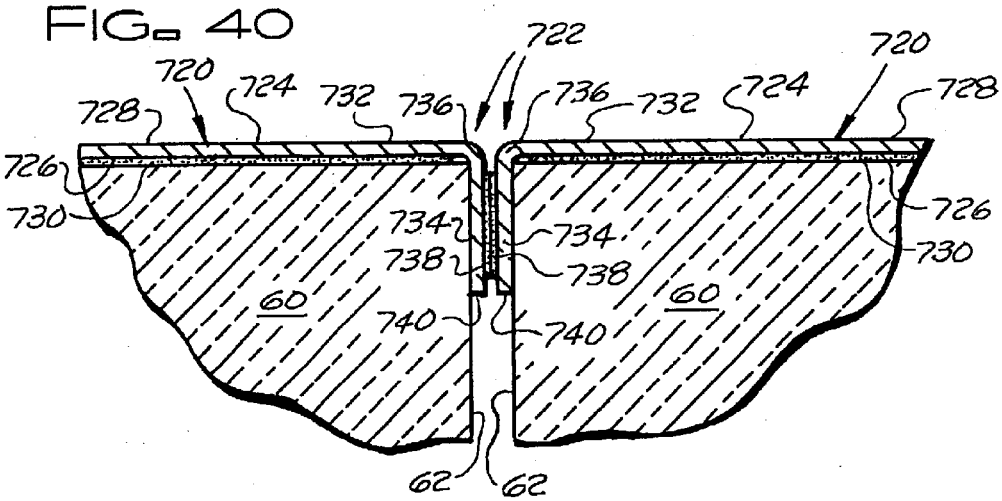
FIG. 40 is an enlarged schematic partial transverse cross section through the lateral edge portions of the faced fibrous insulation blankets of FIG. 39 with the lateral tabs of the facings adhered together for packaging, shipping, storage and handling.
Figure 41:
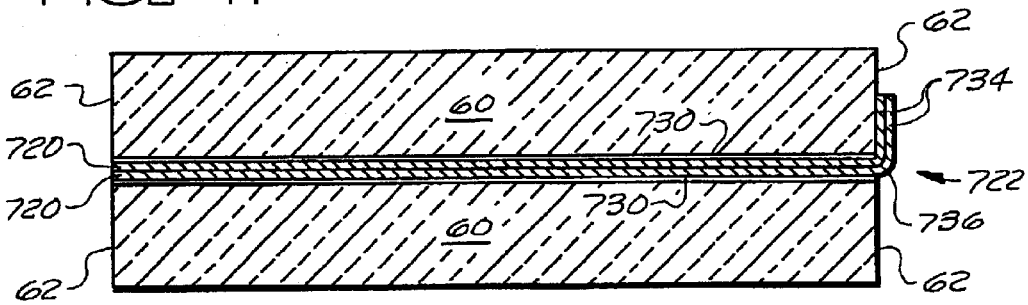
FIG. 41 is an schematic transverse cross section through the pair of faced fibrous insulation blankets of FIG. 39 with one faced blanket folded over on the other faced blanket for packaging, shipping, storage and handling.

FIGS. 39 to 41 show a facing sheet 720 incorporating a sixth embodiment 722 of the lateral tab of the subject invention bonded to a major surface of a resilient fibrous insulation blanket 60. The facing sheet 720 includes one single-folded lateral tab 722 that is integral with a barrier sheet 724 that overlays a major surface of the resilient fibrous insulation blanket 60. The barrier sheet 724 has two major surfaces 726 and 728. The one single-folded lateral tab 722 extends along one lateral edge of the barrier sheet 724 for the length of the barrier sheet 724.

The facing sheet 720 has a length and a width, with the single-folded lateral tab 722 in a folded state, which is substantially equal to the length and the width of the major surface of the fibrous insulation blanket 60. The major surface 726 of the barrier sheet 724 has an adhesive layer 730 thereon (e.g. a hot melt adhesive, water based adhesive, etc.) that bonds the facing sheet 720 to the major surface of the fibrous insulation blanket 60. The adhesive layer 730 that bonds the facing sheet 720 to the major surface of a fibrous insulation blanket 60 may be a continuous layer that extends the entire width of the facing sheet 720 as shown in FIG. 40, or the adhesive layer 730 may be in a pattern, e.g. stripes or dots, a web, etc.

The single-folded lateral tab 722 has first and second segments 732 and 734 with the second segment 734 folded along a lateral surface 62 of the insulation blanket as shown in FIGS. 39 and 41. The first segment 732 of the lateral tab 722 is joined to the second segment 734 of the lateral tab along a fold line 736. The first segment 732 of the lateral tab 722 is a lateral edge portion of the barrier sheet 724. With the single-folded lateral tab 722 in its folded state, the fold line 736 joining the first segment 732 and the second segment 734 of the lateral tab 722 is at the lateral edge of the facing sheet 720 and is located at or adjacent a lateral edge of the major surface of the resilient fibrous insulation blanket 60. As shown in FIG. 40, an outward facing surface of the second segment 734 of the lateral tab 722 has an adhesive 738 (an adhesive of the subject invention described above) thereon for application to the adhesive surface of a similar tab 722 extending along an opposite lateral surface on another faced resilient fibrous insulation blanket during packaging, shipment, storage and handling of the faced insulation blankets prior to installation and for application to a lateral surface of a framing member upon installation. The adhesive 738 may be continuous or patterned coating layers. The adhesive 738 on the second segment 734 of the lateral tab 722 may be spaced inwardly from the free lateral edge of the second segment 734 to provide a flap 740 that may be more easily grasped and pulled to unfold the single-folded lateral tab 722.

For packaging, shipment, storage and handling, the faced resilient fibrous insulation blankets of FIG. 39 are folded over one upon the other as shown in FIG. 41. Since the second segments 734 of the lateral tabs 722 are not bonded to the lateral surfaces 62 of the blankets 60, once the lateral tabs of the two faced insulation blankets are separably bonded together as shown in FIGS. 39 and 40, one of the faced insulation blankets can be folded over on the other as shown in FIG. 41 to later be unfolded and pulled apart at the job site for installation. The faced resilient fibrous insulation blankets of FIGS. 39 to 41 would be installed in the same manner as the faced resilient fibrous insulation blankets of FIGS. 34 to 38.

While FIGS. 39 to 41 show the sixth embodiment of the lateral tab, the single-folded lateral tab 722, on a facing such as the facing 20 of FIG. 1 which has no pairs of separable tabs, the single-folded lateral tab 722 of FIGS. 39 to 41 can be substituted for the lateral tabs 122 on the facing 120 or the lateral tabs 222 on the facing 220 and used to face separable insulation such as the separable resilient pre-cut fibrous insulation blankets 160 of FIGS. 13 to 16 and 260 of FIGS. 17 to 20. Other than the substitution of the lateral tab 722 for the lateral tabs 122 and 222, the separable facings utilizing the lateral tab 722 would be the same as the separable facings 120 and 220.

While as schematically illustrated the lateral tabs and the pairs of separable tabs extend outward from the second major surfaces of the facing, the lateral tabs and the pairs of separable tabs would lie flat or essentially flat on the facing sheet. In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A facing for application to a major surface of an insulation layer, comprising:

a facing sheet; the facing sheet having a length and a width; the facing sheet having first and second major surfaces; the first major surface of the facing sheet to be applied and bonded to a major surface of an insulation layer; the facing sheet having Z-folded lateral tabs extending the length of the facing sheet along lateral edges of the facing sheet; each Z-folded lateral tab having first, second and third segments; the first segment of each lateral tab being joined to the second segment of each lateral tab along a first fold line and the second segment of each lateral tab being joined to the third segment of each lateral tab along a second fold line; the first segment of each lateral tab overlaying the second segment of each lateral tab; the second segment of each lateral tab overlaying the third segment of each lateral tab which is to rest on the major surface of an insulation layer to which the facing sheet is bonded; and a surface of the second segment of each lateral tab that is overlaid by the first segment of each lateral tab having an adhesive thereon whereby when the third segment of either of the lateral tabs is pulled laterally outward the first and second segments of that lateral tab are pulled apart to expose the surface of the second segment of that lateral tab having the adhesive thereon.

2. The facing for application to a major surface of an insulation layer according to claim 1, wherein:

the first major surface of the facing sheet has an adhesive thereon intermediate the lateral tabs to bond the facing sheet to a major surface of an insulation layer.

3. The facing for application to a major surface of an insulation layer according to claim 1, wherein:

the adhesive on the second segment of each lateral tab is a pressure-sensitive adhesive.

4. The facing for application to a major surface of an insulation layer according to claim 3, wherein:

the surface of the first segment of each lateral tab that overlays the surface of the second segment of that lateral tab with the pressure-sensitive adhesive thereon has a release means.

5. The facing for application to a major surface of an insulation layer according to claim 1, wherein:

the adhesive on the second segment of each lateral tab comprises a base adhesive, with sufficient adhesive strength to hold the first and second segments of the tab together, which contains a microencapsulated pressure-sensitive adhesive to be released by rupturing the microcapsules.

6. The facing for application to a major surface of an insulation layer according to claim 1, wherein:

the adhesive on the second segment of each lateral tab comprises a base adhesive, with sufficient adhesive strength to hold the first and second segments of the tab together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

7. The facing for application to a major surface of an insulation layer according to claim 1, wherein:

the facing sheet has a pair of longitudinally extending separable tabs; the pair of separable tabs being spaced inwardly from the lateral edges of the facing sheet and extending from the second major surface of the facing sheet; each of the separable tabs having an unexposed surface with an adhesive thereon; and the pair of separable tabs being separable from each other when pulled apart by hand to longitudinally separate the facing sheet into two pieces and to expose the adhesive on the surfaces of the pair of separable tabs.

8. The facing for application to a major surface of an insulation layer according to claim 7, wherein:

the facing sheet comprises first and second sheets and an edge portion on the first sheet and an edge portion on the second sheet form the pair of separable tabs on the facing sheet.

9. The facing for application to a major surface of an insulation layer according to claim 7, wherein:

a fold in the facing sheet forms the pair of separable tabs of the facing sheet with the pair of separable tabs being separably joined together along a separable fold line.

10. The facing for application to a major surface of an insulation layer according to claim 7, wherein:

the adhesive on the pair of separable tabs is a pressure-sensitive adhesive.

11. The facing for application to a major surface of an insulation layer according to claim 7, wherein:

the adhesive on the pair of separable tabs comprises a base adhesive, with sufficient adhesive strength to hold the pair of separable tabs together, which contains a microencapsulated pressure-sensitive adhesive to be released by rupturing the microcapsules.

12. The facing for application to a major surface of an insulation layer according to claim 7, wherein:

the adhesive on the pair of separable tabs comprises a base adhesive, with sufficient adhesive strength to hold the pair of tabs together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

13. The facing for application to a major surface of an insulation layer according to claim 7 wherein:

the adhesive on the second segment of each lateral tab and the adhesive on the pair of separable tabs is the same adhesive.

14. The facing for application to a major surface of an insulation layer according to claim 7 wherein:

the adhesive on the second segment of each lateral tab and the adhesive on the pair of separable tabs are the different adhesives.

15. The facing for application to a major surface of an insulation layer according to claim 7, wherein:

the adhesive on the second segment of each lateral tab is a pressure-sensitive adhesive.

16. The facing for application to a major surface of an insulation layer according to claim 15, wherein:

the surface of the first segment of each lateral tab that overlays the surface of the second segment of that lateral tab with the pressure-sensitive adhesive thereon has a release means.

17. The facing for application to a major surface of an insulation layer according to claim 7, wherein:

the adhesive on the second segment of each lateral tab comprises a base adhesive, with sufficient adhesive strength to hold the first and second segments of the tab together, which contains a microencapsulated pressure-sensitive adhesive to be released by rupturing the microcapsules.

18. The facing for application to a major surface of an insulation layer according to claim 7, wherein:

the adhesive on the second segment of each lateral tab comprises a base adhesive, with sufficient adhesive strength to hold the first and second segments of the tab together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

19. Faced building insulation, comprising:

an insulation layer; the insulation layer having a length, a width, and a thickness; the insulation layer having a first major surface and a second major surface that each extend for the length and the width of the insulation layer; the insulation layer having lateral surfaces extending between lateral edges of the first and second major surfaces;

a facing sheet overlaying the first major surface of the insulation layer; the facing sheet having first and second major surfaces; the first major surface of the facing sheet being bonded to the first major surface of the insulation layer; the facing sheet being substantially coextensive with the first major surface of the insulation layer; the facing sheet having Z-folded lateral tabs extending the length of the facing sheet along lateral edges of the facing sheet; each Z-folded lateral tab having first, second and third segments; the first segment of each lateral tab being joined to the second segment of each lateral tab along a first fold line and the second segment of each lateral tab being joined to the third segment of each lateral tab along a second fold line; the first segment of each lateral tab overlaying the second segment of each lateral tab; the second segment of each lateral tab overlaying the third segment of each lateral tab which rests on the first major surface of the insulation layer adjacent the lateral edges of the first major surface of the insulation layer; and a surface of the second segment of each lateral tab that is overlaid by the first segment of each lateral tab having an adhesive thereon whereby when the third segment of either of the lateral tabs is pulled laterally outward the first and second segments of that lateral tab are pulled apart to expose the surface of the second segment of that lateral tab having the adhesive thereon beyond one of the lateral edges of the first major surface of the insulation layer.

20. The faced building insulation according to claim 19, wherein:

the insulation layer is a fibrous insulation blanket.

21. The faced building insulation according to claim 19, wherein:

the adhesive on the second segment of each lateral tab is a pressure-sensitive adhesive.

22. The faced building insulation according to claim 21, wherein:

the surface of the first segment of each lateral tab that overlays the surface of the second segment of that lateral tab with the pressure-sensitive adhesive thereon has a release means.

23. The faced building insulation according to claim 19, wherein:

the adhesive on the second segment of each lateral tab comprises a base adhesive, with sufficient adhesive strength to hold the first and second segments of the tab together, which contains a microencapsulated pressure-sensitive adhesive to be released by rupturing the microcapsules.

24. The faced building insulation according to claim 19, wherein:

the adhesive on the second segment of each lateral tab comprises a base adhesive, with sufficient adhesive strength to hold the first and second segments of the tab together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

25. The faced building insulation according to claim 19 wherein:

the insulation layer has first and second longitudinally extending sections of lesser widths than the insulation layer which each extend for the length of the insulation layer; the first and second sections of the insulation layer being joined to each other by separable means spaced inwardly from the lateral surfaces of the insulation layer and extending along the length of the insulation layer; the separable means holding together the first and second sections of the insulation layer for handling and being separable by hand whereby the insulation layer can be handled as a unit for insulating a cavity having a width about equal to the width of the insulation layer or easily separated by hand into sections at the separable means for insulating a cavity having a lesser width; and the facing sheet has a pair of longitudinally extending separable tabs; the pair of separable tabs being spaced inwardly from the lateral edges of the facing sheet and being aligned longitudinally with the separable means of the insulation layer; the pair of separable tabs extending from the second major surface of the facing sheet; each of the separable tabs having an unexposed surface with an adhesive thereon; and the pair of separable tabs being separable from each other by hand along the separable means of the insulation layer to longitudinally separate the facing sheet into two pieces and to expose the surfaces of the pair of separable tabs having the adhesive thereon whereby when the insulation layer is pulled apart to separate the insulation layer between the first and second sections the facing sheet is also separated and the surfaces of the separable tabs having the adhesive thereon are exposed for application to a framing member.

26. The faced building insulation according to claim 25, wherein:

the facing sheet comprises first and second sheets and an edge portion on the first sheet and an edge portion on the second sheet form the pair of separable tabs on the facing sheet.

27. The faced building insulation according to claim 25, wherein:

a fold in the facing sheet forms the pair of separable tabs of the facing sheet with the pair of separable tabs being separably joined together along a separable fold line.

28. The faced building insulation according to claim 25, wherein:

the adhesive on the pair of separable tabs comprises a pressure-sensitive adhesive.

29. The faced building insulation according to claim 25, wherein:

the adhesive on the pair of separable tabs comprises a base adhesive, with sufficient adhesive strength to hold the pair of separable tabs together, which contains a microencapsulated pressure-sensitive adhesive to be released by rupturing the microcapsules.

30. The faced building insulation according to claim 25, wherein:

the adhesive on the pair of separable tabs comprises a base adhesive, with sufficient adhesive strength to hold the pair of tabs together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

31. The faced building insulation according to claim 25 wherein:

the adhesive on the second segment of each lateral tab and the adhesive on the pair of separable tabs are the different adhesives.

32. The faced building insulation according to claim 19, wherein:

the insulation layer is a fibrous insulation blanket; the fibrous insulation blanket has first and second longitudinally extending sections of lesser widths than the fibrous insulation blanket which each extend for the length of the fibrous insulation blanket; the first and second sections of the fibrous insulation blanket being joined to each other by separable means spaced inwardly from the lateral surfaces of the fibrous insulation blanket and extending along the length of the fibrous insulation blanket; the separable means holding together the first and second sections of the fibrous insulation blanket for handling and being separable by hand whereby the fibrous insulation blanket can be handled as a unit for insulating a cavity having a width about equal to the width of the fibrous insulation blanket or easily separated by hand into sections at the separable means for insulating a cavity having a lesser width; and the facing sheet has a pair of longitudinally extending separable tabs; the pair of separable tabs being spaced inwardly from the lateral edges of the facing sheet and being aligned longitudinally with the separable means of the fibrous insulation blanket; the pair of separable tabs extending from the second major surface of the facing sheet; each of the separable tabs having an unexposed surface with an adhesive thereon; and the pair of separable tabs being separable from each other by hand along the separable means of the fibrous insulation blanket to longitudinally separate the facing sheet into two pieces and to expose the surfaces of the pair of separable tabs having the adhesive thereon whereby when the fibrous insulation blanket is pulled apart to separate the fibrous insulation blanket between the first and second sections the facing sheet is also separated and the surfaces of the separable tabs having the adhesive thereon are exposed for application to a framing member.

33. A facing for application to a major surface of an insulation layer, comprising:

a facing sheet; the facing sheet having a length and a width; the facing sheet having first and second major surfaces; the facing sheet having double-folded lateral tabs and a barrier sheet portion extending between the lateral tabs; the first major surface of the barrier sheet portion of the facing sheet to be applied and bonded to a major surface of an insulation layer; the lateral tabs extending the length of the facing sheet along lateral edges of the barrier sheet portion of the facing sheet; each lateral tab having first, second and third segments; the first segment of each lateral tab being a lateral edge portion of the barrier sheet portion of the facing sheet; the first segment being joined to the second segment of each lateral tab along a first fold line and the second segment of each lateral tab being joined to the third segment of each lateral tab along a second fold line; the second segment of each lateral tab overlaying the third segment of each lateral tab; the third segment of each lateral tab overlaying the first segment of each lateral tab; and a surface of the third segment of each lateral tab that opposes and overlays the first segment of each lateral tab having an adhesive thereon whereby when the third segment of either of the lateral tabs is pulled laterally outward the second and third segments of that lateral tab are pulled apart to expose the surface of the third segment of that lateral tab having the adhesive thereon.

34. The facing for application to a major surface of an insulation layer according to claim 33, wherein:

the first major surface of the barrier sheet portion of the facing sheet has an adhesive thereon to bond the facing sheet to a major surface of an insulation layer.

35. The facing for application to a major surface of an insulation layer according to claim 33, wherein:

the adhesive on the third segment of each lateral tab is a pressure-sensitive adhesive.

36. The facing for application to a major surface of an insulation layer according to claim 35, wherein:

the surface of the first segment of each lateral tab that is overlaid by the surface of the third segment of each lateral tab with the pressure-sensitive adhesive thereon has a release means.

37. The facing for application to a major surface of an insulation layer according to claim 35, wherein:

the adhesive on the third segment of each lateral tab comprises a base adhesive, with sufficient adhesive strength to hold the third and first segments of the tab together, which contains a microencapsulated pressure-sensitive adhesive to be released by rupturing the microcapsules.

38. The facing for application to a major surface of an insulation layer according to claim 33, wherein:

the adhesive on the third segment of each lateral tab comprises a base adhesive, with sufficient adhesive strength to hold the third and first segments of the tab together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

39. The facing for application to a major surface of an insulation layer according to claim 33, wherein:

the facing sheet has a pair of longitudinally extending separable tabs; the pair of separable tabs being spaced inwardly from the lateral edges of the facing sheet and extending from the second major surface of the facing sheet; each of the separable tabs having an unexposed surface with an adhesive thereon; and the pair of separable tabs being separable from each other when pulled apart by hand to longitudinally separate the facing sheet into two pieces and to expose the adhesive on the surfaces of the pair of separable tabs.

40. The facing for application to a major surface of an insulation layer according to claim 39, wherein:

the facing sheet comprises first and second sheets and an edge portion on the first sheet and an edge portion on the second sheet form the pair of separable tabs on the facing sheet.

41. The facing for application to a major surface of an insulation layer according to claim 39, wherein:

a fold in the facing sheet forms the pair of separable tabs of the facing sheet with the pair of separable tabs being separably joined together along a separable fold line.

42. Faced building insulation, comprising:

an insulation layer; the insulation layer having a length, a width, and a thickness; the insulation layer having a first major surface and a second major surface that each extend for the length and the width of the insulation layer; the insulation layer having lateral surfaces extending between lateral edges of the first and second major surfaces; and a facing sheet overlaying and being substantially coextensive with the first major surface of the insulation layer; the facing sheet having first and second major surfaces; the facing sheet having double-folded lateral tabs and a barrier sheet portion extending between the lateral tabs; the first major surface of the barrier sheet portion of the facing sheet being bonded to the first major surface of the insulation layer; the lateral tabs extending the length of the facing sheet along lateral edges of the barrier sheet portion of the facing sheet; each lateral tab having first, second and third segments; the first segment of each lateral tab being a lateral edge portion of the barrier sheet portion of the facing sheet; the first segment being joined to the second segment of each lateral tab along a first fold line; the second segment of each lateral tab being joined to the third segment of each lateral tab along a second fold line; the second segment of each lateral tab overlaying the third segment of each lateral tab; the third segment of each lateral tab overlaying the first segment of each lateral tab; and a surface of the third segment of each lateral tab that opposes and overlays the first segment of each lateral tab having an adhesive thereon whereby when the second and third segments of either of the lateral tabs are pulled laterally outward and folded about the first fold line to extend along one of the lateral surfaces of the insulation layer, the second and third segments of that lateral tab are pulled apart to expose the surface of the third segment of that lateral tab having the adhesive thereon and the surface of the third segment of that lateral tab having the adhesive thereon faces outwardly away from the one lateral surface of the insulation layer.

43. A facing for application to a major surface of an insulation layer, comprising:

a facing sheet; the facing sheet having a length and a width; the facing sheet having first and second major surfaces; the facing sheet having Z-folded lateral tabs and a barrier sheet portion extending between the lateral tabs; the first major surface of the barrier sheet portion of the facing sheet is to be applied and bonded to a major surface of an insulation layer; the lateral tabs extending the length of the facing sheet along lateral edges of the barrier sheet portion of the facing sheet; each lateral tab having first, second and third segments; the first segment of each lateral tab being joined to the second segment of each lateral tab along a first fold line; the second segment of each lateral tab being joined to the third segment of each lateral tab along a second fold line; the first segment of each lateral tab overlays and is bonded to the second major surface of the barrier sheet portion of the facing sheet; the first segment of each lateral tab being spaced inwardly from an adjacent lateral edge of the barrier sheet portion of the facing sheet; the second segment of each lateral tab overlaying the first segment of each lateral tab and having a width about equal to or greater than one half of the spacing of the first segment of the lateral tab from the adjacent lateral edge of the barrier sheet portion of the facing sheet; the third segment of the lateral tab overlaying the second segment of the lateral tab and extending laterally beyond the second segment to overlay part or all of that portion of the barrier sheet portion of the facing sheet between the first segment of the lateral tab and the adjacent lateral edge of the barrier sheet portion of the facing sheet; a surface of that portion of the third segment of the lateral tab that extends laterally beyond the second segment of the lateral tab having an adhesive separably bonding the third segment of the lateral tab to that portion of the barrier sheet portion of the facing sheet between the first segment of the lateral tab and the adjacent lateral edge of the barrier sheet portion of the facing sheet whereby when the third segment of the lateral tab is pulled laterally outward to unfold the lateral tab, the portion of the surface of the third segment with the adhesive thereon extends laterally beyond the barrier sheet portion of the facing sheet.

44. The facing for application to a major surface of an insulation layer according to claim 43, wherein:

the first major surface of the barrier sheet portion of the facing sheet has an adhesive thereon to bond the facing sheet to a major surface of an insulation layer.

45. The facing for application to a major surface of an insulation layer according to claim 43, wherein:

the adhesive on the third segment of each lateral tab is a pressure-sensitive adhesive.

46. The facing for application to a major surface of an insulation layer according to claim 45, wherein:

the surface of the barrier sheet portion that is overlaid by the surface of the third segment of each lateral tab with the pressure-sensitive adhesive thereon has a release means.

47. The facing for application to a major surface of an insulation layer according to claim 43, wherein:

the adhesive on the third segment of each lateral tab comprises a base adhesive, with sufficient adhesive strength to hold the third and first segments of the tab together, which contains a microencapsulated pressure-sensitive adhesive to be released by rupturing the microcapsules.

48. The facing for application to a major surface of an insulation layer according to claim 43, wherein:

the adhesive on the third segment of each lateral tab comprises a base adhesive, with sufficient adhesive strength to hold the third and first segments of the tab together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

49. The facing for application to a major surface of an insulation layer according to claim 43, wherein:

the facing sheet has a pair of longitudinally extending separable tabs; the pair of separable tabs being spaced inwardly from the lateral edges of the facing sheet and extending from the second major surface of the facing sheet; each of the separable tabs having an unexposed surface with an adhesive thereon; and the pair of separable tabs being separable from each other when pulled apart by hand to longitudinally separate the facing sheet into two pieces and to expose the adhesive on the surfaces of the pair of separable tabs.

50. The facing for application to a major surface of an insulation layer according to claim 49, wherein:

the facing sheet comprises first and second sheets and an edge portion on the first sheet and an edge portion on the second sheet form the pair of separable tabs on the facing sheet.

51. The facing for application to a major surface of an insulation layer according to claim 49, wherein:

a fold in the facing sheet forms the pair of separable tabs of the facing sheet with the pair of separable tabs being separably joined together along a separable fold line.

52. Faced building insulation, comprising:

an insulation layer; the insulation layer having a length, a width, and a thickness; the insulation layer having a first major surface and a second major surface that each extend for the length and the width of the insulation layer; the insulation layer having lateral surfaces extending between lateral edges of the first and second major surfaces; and a facing sheet overlaying and being substantially coextensive with the first major surface of the insulation layer; the facing sheet having first and second major surfaces; the facing sheet having Z-folded lateral tabs and a barrier sheet portion extending between the lateral tabs; the first major surface of the barrier sheet portion of the facing sheet being bonded to the first major surface of the insulation layer; the lateral tabs extending the length of the facing sheet along lateral edges of the barrier sheet portion of the facing sheet; each lateral tab having first, second and third segments; the first segment of each lateral tab being joined to the second segment of each lateral tab along a first fold line; the second segment of each lateral tab being joined to the third segment of each lateral tab along a second fold line; the first segment of each lateral tab overlays and is bonded to the second major surface of the barrier sheet portion of the facing sheet; the first segment of each lateral tab being spaced inwardly from an adjacent lateral edge of the barrier sheet portion of the facing sheet and the adjacent lateral edge of the major surface of the insulation layer; the second segment of each lateral tab overlaying the first segment of each lateral tab and having a width about equal to or greater than one half of the spacing of the first segment of the lateral tab from the adjacent lateral edge of the barrier sheet portion of the facing sheet; the third segment of the lateral tab overlaying the second segment of the lateral tab and extending laterally beyond the second segment to overlay part or all of that portion of the barrier sheet portion of the facing sheet between the first segment of the lateral tab and the adjacent lateral edge of the barrier sheet portion of the facing sheet; a surface of that portion of the third segment of the lateral tab that extends laterally beyond the second segment of the lateral tab having an adhesive separably bonding the third segment of the lateral tab to that portion of the barrier sheet portion of the facing sheet between the first segment of the lateral tab and the adjacent lateral edge of the barrier sheet portion of the facing sheet whereby when the third segment of the lateral tab is pulled laterally outward to unfold the lateral tab, the portion of the surface of the third segment with the adhesive thereon extends laterally beyond the barrier sheet portion of the facing sheet and the adjacent lateral edge of the major surface of the insulation layer.

53. A facing for application to a major surface of an insulation layer, comprising:

a facing sheet; the facing sheet having a length and a width; the facing sheet having first and second major surfaces; the facing sheet having Z-folded lateral tabs and a barrier sheet portion extending between the lateral tabs; the first major surface of the barrier sheet portion of the facing sheet is to be applied and bonded to a major surface of an insulation layer; the lateral tabs extending the length of the facing sheet along lateral edges of the barrier sheet portion of the facing sheet; each lateral tab having first, second and third segments; the first segment of each lateral tab being a lateral edge portion of the barrier sheet portion of the facing sheet; the first segment of each lateral tab being joined to the second segment of each lateral tab along a first fold line; the second segment of each lateral tab being joined to the third segment of each lateral tab along a second fold line; with each lateral tab in its folded state, the first fold line joining the first segment and the second segment of each lateral tab is at a lateral edge of the facing sheet; the second segment of each lateral tab overlaying the first segment of each lateral tab; the third segment of each lateral tab overlaying the second segment of each lateral tab; the second and third segments having substantially equal widths; a surface of the third segment of each lateral tab that overlays the second segment of each lateral tab having an adhesive thereon separably bonding the third segment to the second segment whereby when the third segment of either lateral tab is pulled laterally outward to unfold the lateral tab, the surface of the third segment with the adhesive thereon extends laterally beyond the lateral edge of the facing sheet defined by the first fold line with the lateral tab in its folded state.

54. The facing for application to a major surface of an insulation layer according to claim 53, wherein:

the first major surface of the barrier sheet portion of the facing sheet has an adhesive thereon to bond the facing sheet to a major surface of an insulation layer.

55. The facing for application to a major surface of an insulation layer according to claim 53, wherein:

the adhesive on the third segment of each lateral tab is a pressure-sensitive adhesive.

56. The facing for application to a major surface of an insulation layer according to claim 55, wherein:

the surface of the second segment that is overlaid by the surface of the third segment of each lateral tab with the pressure-sensitive adhesive thereon has a release means.

57. The facing for application to a major surface of an insulation layer according to claim 53, wherein:

the adhesive on the third segment of each lateral tab comprises a base adhesive, with sufficient adhesive strength to hold the third and first segments of the tab together, which contains a microencapsulated pressure-sensitive adhesive to be released by rupturing the microcapsules.

58. The facing for application to a major surface of an insulation layer according to claim 53, wherein:

the adhesive on the third segment of each lateral tab comprises a base adhesive, with sufficient adhesive strength to hold the third and first segments of the tab together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

59. The facing for application to a major surface of an insulation layer according to claim 53, wherein:

the facing sheet has a pair of longitudinally extending separable tabs; the pair of separable tabs being spaced inwardly from the lateral edges of the facing sheet and extending from the second major surface of the facing sheet; each of the separable tabs having an unexposed surface with an adhesive thereon; and the pair of separable tabs being separable from each other when pulled apart by hand to longitudinally separate the facing sheet into two pieces and to expose the adhesive on the surfaces of the pair of separable tabs.

60. The facing for application to a major surface of an insulation layer according to claim 59, wherein:

the facing sheet comprises first and second sheets and an edge portion on the first sheet and an edge portion on the second sheet form the pair of separable tabs on the facing sheet.

61. The facing for application to a major surface of an insulation layer according to claim 59, wherein:

a fold in the facing sheet forms the pair of separable tabs of the facing sheet with the pair of separable tabs being separably joined together along a separable fold line.

62. Faced building insulation, comprising:

an insulation layer; the insulation layer having a length, a width, and a thickness; the insulation layer having a first major surface and a second major surface that each extend for the length and the width of the insulation layer; the insulation layer having lateral surfaces extending between lateral edges of the first and second major surfaces; and a facing sheet overlaying and being substantially coextensive in length with the first major surface of the insulation layer; lateral edges of the facing sheet being spaced inwardly from the lateral edges of the first major surface of the insulation layer; the facing sheet having first and second major surfaces; the facing sheet having Z-folded lateral tabs and a barrier sheet portion extending between the lateral tabs; the first major surface of the barrier sheet portion of the facing sheet being bonded to the first major surface of the insulation layer; the lateral tabs extending the length of the facing sheet along lateral edges of the barrier sheet portion of the facing sheet; the first segment of each lateral tab being a lateral edge portion of the barrier sheet portion of the facing sheet; the first segment of each lateral tab being joined to the second segment of each lateral tab along a first fold line; the second segment of each lateral tab being joined to the third segment of each lateral tab along a second fold line; with each lateral tab in its folded state, the first fold line joining the first segment and the second segment of each lateral tab is at one of the lateral edges of the facing sheet; the second segment of each lateral tab overlaying the first segment of each lateral tab; the third segment of each lateral tab overlaying the second segment of each lateral tab; the second and third segments having substantially equal widths; a surface of the third segment of each lateral tab that overlays the second segment of each lateral tab having an adhesive thereon separably bonding the third segment to the second segment whereby when the third segment of either lateral tab is pulled laterally outward to unfold the lateral tab, the surface of the third segment with the adhesive thereon extends laterally beyond the adjacent lateral edge of the first major surface of the insulation layer.

63. A facing for application to a major surface of an insulation layer, comprising:

a facing sheet; the facing sheet having a length and a width; the facing sheet having first and second major surfaces; the facing sheet only one single-folded lateral tab and a barrier sheet portion; the first major surface of the barrier sheet portion of the facing sheet is to be applied and bonded to a major surface of an insulation layer; the lateral tab extending the length of the facing sheet along a lateral edge of the barrier sheet portion of the facing sheet; the lateral tab having first and second segments; the first segment of the lateral tab being a lateral edge portion of the barrier sheet portion of the facing sheet; the first segment of the lateral tab being joined to the second segment of the lateral tab along a first fold line; with the lateral tab in its folded state, the first fold line joining the first segment and the second segment of the lateral tab is at a lateral edge of the facing sheet; the second segment of the lateral tab overlaying the first segment of the lateral tab; a surface of the second segment of the lateral tab that overlays and opposes the first segment of the lateral tab having an adhesive thereon separably bonding the second segment to the first segment whereby when the second segment of the lateral tab is pulled laterally outward to unfold the lateral tab, the surface of the second segment with the adhesive thereon extends laterally beyond the lateral edge of the facing sheet defined by the first fold line with the lateral tab in its folded state.

64. The facing for application to a major surface of an insulation layer according to claim 63, wherein:

the first major surface of the barrier sheet portion of the facing sheet has an adhesive thereon to bond the facing sheet to a major surface of an insulation layer.

65. The facing for application to a major surface of an insulation layer according to claim 63, wherein:

the adhesive on the second segment of the lateral tab is a pressure-sensitive adhesive.

66. The facing for application to a major surface of an insulation layer according to claim 65, wherein:

the surface of the first segment that is overlaid by the surface of the second segment of the lateral tab with the pressure-sensitive adhesive thereon has a release means.

67. The facing for application to a major surface of an insulation layer according to claim 63, wherein:

the adhesive on the second segment of the lateral tab comprises a base adhesive, with sufficient adhesive strength to hold the third and first segments of the tab together, which contains a microencapsulated pressure-sensitive adhesive to be released by rupturing the microcapsules.

68. The facing for application to a major surface of an insulation layer according to claim 63, wherein:

the adhesive on the second segment of the lateral tab comprises a base adhesive, with sufficient adhesive strength to hold the third and first segments of the tab together, that contains one or more microencapsulated additional adhesive constituents to be released by rupturing the microcapsules to react with the base adhesive and/or another released, previously microencapsulated additional adhesive constituent to form an adhesive with greater bonding strength than the base adhesive.

69. The facing for application to a major surface of an insulation layer according to claim 63, wherein:

the facing sheet has a pair of longitudinally extending separable tabs; the pair of separable tabs being spaced inwardly from the lateral edges of the facing sheet and extending from the second major surface of the facing sheet; each of the separable tabs having an unexposed surface with an adhesive thereon; and the pair of separable tabs being separable from each other when pulled apart by hand to longitudinally separate the facing sheet into two pieces and to expose the adhesive on the surfaces of the pair of separable tabs.

70. The facing for application to a major surface of an insulation layer according to claim 69, wherein:

the facing sheet comprises first and second sheets and an edge portion on the first sheet and an edge portion on the second sheet form the pair of separable tabs on the facing sheet.

71. The facing for application to a major surface of an insulation layer according to claim 69, wherein:

a fold in the facing sheet forms the pair of separable tabs of the facing sheet with the pair of separable tabs being separably joined together along a separable fold line.

72. Faced building insulation, comprising:

an insulation layer; the insulation layer having a length, a width, and a thickness; the insulation layer having a first major surface and a second major surface that each extend for the length and the width of the insulation layer; the insulation layer having lateral surfaces extending between lateral edges of the first and second major surfaces; and a facing sheet overlaying and being substantially coextensive with the first major surface of the insulation layer; the facing sheet having first and second major surfaces; the facing sheet having only one single-folded lateral tab and a barrier sheet portion; the first major surface of the barrier sheet portion of the facing sheet being bonded to a major surface of an insulation layer; the lateral tab extending the length of the facing sheet along a lateral edge of the barrier sheet portion of the facing sheet; the lateral tab having first and second segments; the first segment of the lateral tab being a lateral edge portion of the barrier sheet portion of the facing sheet; the first segment of the lateral tab being joined to the second segment of the lateral tab along a first fold line; with the lateral tab in its folded state, the first fold line joining the first segment and the second segment of the lateral tab is at a lateral edge of the facing sheet and the first major surface of the insulation layer; the second segment of the lateral tab overlaying the first segment of the lateral tab; a surface of the second segment of the lateral tab that overlays and opposes the first segment of the lateral tab having an adhesive thereon separably bonding the second segment to the first segment whereby when the second segment of the lateral tab is pulled laterally outward to unfold the lateral tab and extended along one of the lateral surfaces of the insulation layer, the surface of the second segment with the adhesive thereon faces outwardly away from the lateral surface the insulation layer that the second segment overlays.

73. Faced building insulation, comprising:

a first faced building insulation layer comprising an insulation layer; the insulation layer having a length, a width, and a thickness; the insulation layer having a first major surface and a second major surface that each extend for the length and the width of the insulation layer; the insulation layer having lateral surfaces extending between lateral edges of the first and second major surfaces; and a facing sheet overlaying and being substantially coextensive with the first major surface of the insulation layer; the facing sheet having first and second major surfaces; the facing sheet having only one single-folded lateral tab and a barrier sheet portion; the first major surface of the barrier sheet portion of the facing sheet being bonded to a major surface of an insulation layer; the lateral tab extending the length of the facing sheet along a lateral edge of the barrier sheet portion of the facing sheet; the lateral tab having first and second segments; the first segment of the lateral tab being a lateral edge portion of the barrier sheet portion of the facing sheet; the first segment of the lateral tab being joined to the second segment of the lateral tab along a first fold line;

a surface of the second segment of the lateral tab having an adhesive thereon; the second segment of the lateral tab extending along one of the lateral surfaces of the insulation layer with the surface of the second segment with the adhesive thereon facing outwardly away from the lateral surface of the insulation layer that the second segment overlays;

a second faced building insulation layer identical to the first faced building insulation layer except the second faced building insulation layer has only one lateral tab located at a lateral edge of a first major surface of an insulation layer that is an opposite lateral edge to the lateral edge of the first major surface of the insulation layer of the first faced building insulation layer where the lateral tab of the first faced building insulation layer is located; a second segment of the lateral tab of the second faced building insulation layer extending along a lateral surface of the insulation layer of the second faced building insulation layer; and the second segment of the lateral tab of the first faced building insulation layer being separably bonded to the second segment of the lateral tab of the second faced building insulation layer.

74. A facing for application to a major surface of an insulation layer, comprising:

a facing sheet; the facing sheet having a length and a width; the facing sheet having first and second major surfaces; the first major surface of the facing sheet to be applied and bonded to a major surface of a fibrous insulation blanket; the facing sheet having lateral tabs extending the length of the facing sheet along lateral edges of the facing sheet; a surface of each lateral tab having an adhesive thereon for securing the facing sheet to a framing member; the adhesive comprising a microencapsulated pressure-sensitive adhesive to be released by rupturing the microcapsules; the adhesive on each lateral tab having no separate release liner thereon to be removed prior to bonding the lateral tab to a frame member; and the facing sheet having a air of longitudinally extending separable tabs the air of separable tabs being spaced inwardly from the lateral edges of the facing sheet and extending from the second major surface of the facing sheet; each of the separable tabs having an unexposed surface with an adhesive thereon; and the pair of separable tabs being separable from each other when pulled apart by hand to longitudinally separate the facing sheet into two pieces and to expose the adhesive on the surfaces of the pair of separable tabs.

75. A facing for application to a major surface of an insulation layer, comprising:

a facing sheet; the facing sheet having a length and a width; the facing sheet having first and second major surfaces; the first major surface of the facing sheet to be applied and bonded to a major surface of a fibrous insulation blanket; the facing sheet having lateral tabs extending the length of the facing sheet along lateral edges of the facing sheet; a surface of each lateral tab having an adhesive thereon for securing the facing sheet to a framing member the adhesive comprising one or more microencapsulated adhesive constituents to be released by rupturing the microcapsules to react another adhesive constituent to form an adhesive; the adhesive on each lateral tab having no separate release liner thereon to be removed prior to bonding the lateral tab to a frame member; and the facing sheet has a pair of longitudinally extending separable tabs; the pair of separable tabs being spaced inwardly from the lateral edges of the facing sheet and extending from the second major surface of the facing sheet; each of the separable tabs having an unexposed surface with an adhesive thereon; and the pair of separable tabs being separable from each other when pulled apart by hand to longitudinally separate the facing sheet into two pieces and to expose the adhesive on the surfaces of the pair of separable tabs.

* * * * *